US011587394B2

(12) United States Patent
Fan et al.

(10) Patent No.: US 11,587,394 B2
(45) Date of Patent: Feb. 21, 2023

(54) SYSTEM AND METHOD FOR REDUCING MEMORY REQUIREMENTS FOR A USER INTERFACE

(71) Applicant: Fusion Holdings Ltd, Douglas (IM)

(72) Inventors: Nolan Bennuo Yang Fan, Kowloon (HK); Hiu Yan Lau, Kowloon (HK)

(73) Assignee: Games Global Operations Limited, Douglas (IM)

( * ) Notice: Subject to any disclaimer, the term of this patent is extended or adjusted under 35 U.S.C. 154(b) by 4 days.

(21) Appl. No.: 17/151,309

(22) Filed: Jan. 18, 2021

(65) Prior Publication Data

US 2021/0241574 A1 Aug. 5, 2021

(30) Foreign Application Priority Data

Jan. 31, 2020 (GB) ..... 2001367.8

(51) Int. Cl.
*G07F 17/32* (2006.01)

(52) U.S. Cl.
CPC ..... *G07F 17/3227* (2013.01); *G07F 17/3211* (2013.01); *G07F 17/3223* (2013.01)

(58) Field of Classification Search
CPC ..... G07F 17/3211; G07F 17/3223; G07F 17/3227; G07F 17/32; G07F 17/3204
See application file for complete search history.

(56) References Cited

U.S. PATENT DOCUMENTS

| | | | | |
|---|---|---|---|---|
| 10,262,500 | B2 * | 4/2019 | Wortmann | G07F 17/34 |
| 10,332,357 | B2 * | 6/2019 | Berman | G07F 17/326 |
| 10,354,493 | B2 * | 7/2019 | Kudo | G07F 17/3267 |
| 10,522,005 | B2 * | 12/2019 | Wortmann | G07F 17/3269 |
| 10,922,923 | B2 * | 2/2021 | Ludwick | G07F 17/3211 |
| 2008/0132322 | A1 * | 6/2008 | Yoshizawa | G07F 17/32 463/20 |

(Continued)

*Primary Examiner* — Seng H Lim
(74) *Attorney, Agent, or Firm* — McDonnell Boehnen Hulbert & Berghoff LLP

(57) ABSTRACT

A computer-implemented for reducing memory requirements for a user interface method includes generating, by one or more processors, a first matrix of symbols with columns that correspond to reels of cyclical symbols. The reels are configured to be rendered in adjacent sections of a display. The method further includes rotating, by one or more processors, each reel by a random amount responsive to receiving a spinning instruction. The method includes configuring a first reel to occupy both a first section of the display associated with the first reel and a second section of the display associated with an adjacent reel so that the adjacent reel will not be rendered when a pattern of symbols of the rendered reels is determined to correspond to a particular pattern. Data that represents the symbols of the reels is maintained in a shadow matrix stored in memory. The one or more processors determine the existence of particular patterns from the shadow matrix and search a table in memory for scores associated with the patterns. Data in the shadow matrix is copied between cells of the shadow matrix to correspond to the rendered reels in such a way as to obviate increasing the size of the table. This, in turn, reduces memory requirements associated with the rendering of the reels.

10 Claims, 19 Drawing Sheets

(56) References Cited

U.S. PATENT DOCUMENTS

| | | | | |
|---|---|---|---|---|
| 2008/0146319 | A1* | 6/2008 | Yoshizawa | G07F 17/3265 463/21 |
| 2011/0201406 | A1* | 8/2011 | Jaffe | G07F 17/34 463/21 |
| 2014/0087830 | A1* | 3/2014 | Gobe | G07F 17/323 463/20 |
| 2014/0274288 | A1* | 9/2014 | Hornik | G07F 17/326 463/20 |
| 2015/0287269 | A1* | 10/2015 | Berman | G07F 17/326 463/20 |
| 2016/0093152 | A1* | 3/2016 | Hendricks | G07F 17/3216 463/21 |
| 2017/0092041 | A1* | 3/2017 | Kudo | G07F 17/3267 |
| 2018/0130288 | A1* | 5/2018 | Lamb | G07F 17/3262 |
| 2018/0225926 | A1* | 8/2018 | Wortmann | G07F 17/3288 |
| 2019/0295376 | A1* | 9/2019 | Ludwick | G07F 17/3267 |
| 2019/0355206 | A1* | 11/2019 | Kania | G07F 17/3213 |
| 2021/0304562 | A1* | 9/2021 | Penacho | G06F 7/58 |

* cited by examiner

400

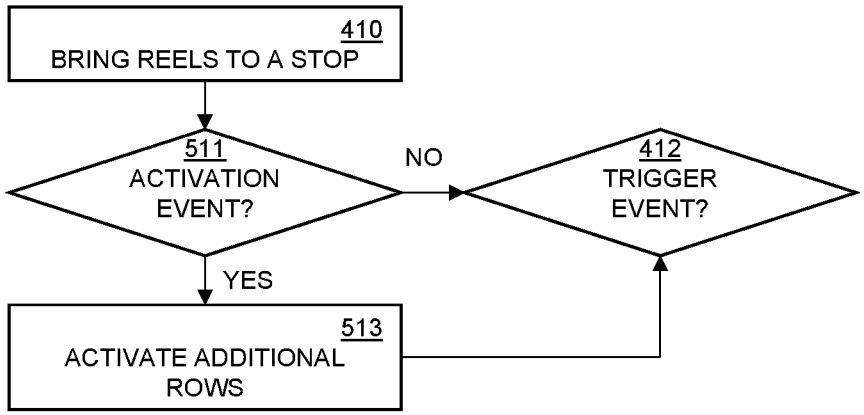
FIGURE 5A
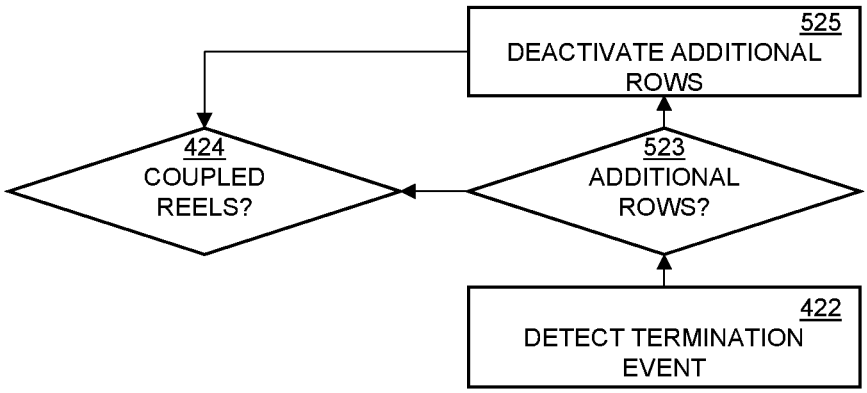
FIGURE 5B
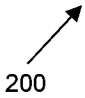

900

SYSTEM AND METHOD FOR REDUCING MEMORY REQUIREMENTS FOR A USER INTERFACE

CROSS-REFERENCE TO RELATED APPLICATIONS

The present application is a non-provisional patent application claiming priority to United Kingdom Patent Application No. 2001367.8, filed Jan. 31, 2020, the contents of which are hereby incorporated by reference.

FIELD OF THE DISCLOSURE

The present disclosure generally relates to computer systems that utilize a graphical user interface to facilitate interaction with a user. More particularly, the disclosure is directed to a system and method for reducing memory requirements for a user interface.

BACKGROUND

A graphical user interface (GUI) is a type of user interface in which graphical icons are presented on a display and selected by a user via a pointing device, such as a mouse or trackpad. Many computing systems utilize a GUI because the learning curve associated with operating such a computing system is perceived to be relatively low when compared to a text-based user interface. For example, most desktop computers sold today are provided with GUI based operating systems such as Windows® or OSx®. Various handheld computing devices such as smartphones, MP3 players, portable media players, etc. are provided with GUI based operating systems such as IOS® and Android®.

Implementation of a GUI on a given computing platform can be computationally intensive. For example, some GUIs require a dedicated graphics processor to achieve peak performance in terms of resolution and responsiveness. Moreover, memory requirements for rendering a GUI tend to increase as the resolution of the GUI increases, and as the number of elements to be rendered via the GUI increases. These and other issues will become apparent upon reading the present disclosure.

SUMMARY

In a first aspect, a computer-implemented method is disclosed. The method includes providing, in a memory component of a computing device, a matrix including a plurality of columns and rows, with each column representing a virtual reel having a virtual reel strip associated therewith, the virtual reel strip having a plurality of symbols thereon.

Examples of the method can include spinning the reels. Examples of the method can include bringing the reels to a stop in positions determined by a random number generator (RNG). Examples of the method can include, responsive to a trigger event, increasing the stacking of symbols on a primary reel strip associated with a primary reel. Examples of the method can include coupling the primary reel to an uncoupled, adjacent secondary reel. Examples of the method can include applying a primary reel strip to any coupled reels. Examples of the method can include spinning the reels again. Examples of the method can include, responsive to a termination event, uncoupling any coupled reels. Examples of the method can include resetting any copied reel strips to their original condition. Yet further, the method includes resetting the stacking on the primary reel strip.

The trigger event may be any win achieved with a reel position after a spin, as long as a maximum number of consecutive wins has not been reached.

The termination event may be that a win has not occurred, or that a win has occurred that increases the number of consecutive wins to the maximum number.

In a second aspect, a computer-implemented method is disclosed. The method includes generating, by one or more processors, a first matrix of symbols with columns that correspond to reels of cyclical symbols. The reels are configured to be rendered in adjacent sections of a display. The method further includes rotating, by one or more processors, each reel by a random amount responsive to receiving a spinning instruction. The method includes configuring a first reel to occupy both a first section of the display associated with the first reel and a second section of the display associated with an adjacent reel so that the adjacent reel will not be rendered when a pattern of symbols of the rendered reels is determined to correspond to a particular pattern.

In a third aspect, an article of manufacture may include a non-transitory computer-readable medium, having stored thereon program instructions, that upon execution by at least one processor, cause a computing device to perform the operations of the first or second aspects.

In a fourth aspect, a computing device may include at least one processor, a memory component, and program instructions stored in the memory component that, upon execution by the at least one processor, cause the computing device to perform the operations of the first or second aspects.

In a fifth aspect, a system may include various means for carrying out the operations of the first or second aspects.

In a sixth aspect, a computer program may include machine-readable instructions executable to cause a computing device to perform the operations of the first or second aspects.

In a seventh aspect, a system includes a display device, a plurality of input devices, at least one processor, and at least one memory. The input devices include an acceptor device configured to receive and validate a physical item associated with a monetary value, and (ii) a cash-out button actuatable to cause an initiation of a payout associated with a credit account. The memory device that stores instructions executable by the processor to cause the processor to perform operations that included generating a first matrix of symbols with columns that correspond to reels of cyclical symbols. The reels are configured to be rendered in adjacent sections of the display device. The processor rotates each reel by a random amount responsive to receiving a spinning instruction via one of the plurality of input devices. The processor configures a first reel to occupy both a first section of the display device associated with the first reel and a second section of the display device associated with an adjacent reel so that the adjacent reel will not be rendered a pattern of symbols of the rendered reels is determined to correspond to a particular pattern.

In embodiments of the disclosure in which a computer software product is used, the product may be non-transitory and store instructions on physical media such as a DVD, or a solid-state drive, or a hard drive. Alternatively, the product may be transitory and in the form of instructions provided over a connection such as a network connection that is linked to a network such as the Internet.

These aspects, as well as other embodiments, aspects, advantages, and alternatives, will become apparent to those of ordinary skill in the art by reading the following detailed description, with reference where appropriate to the accompanying drawings. Further, this summary and other descriptions and figures provided herein are intended to illustrate embodiments by way of example only and, as such, that numerous variations are possible. For instance, structural elements and process steps can be rearranged, combined, distributed, eliminated, or otherwise changed, while remaining within the scope of the embodiments as claimed.

BRIEF DESCRIPTION OF THE FIGURES

FIGS. 5A and 5B are flow diagrams, in accordance with example embodiments.

DETAILED DESCRIPTION

Figure 1A:
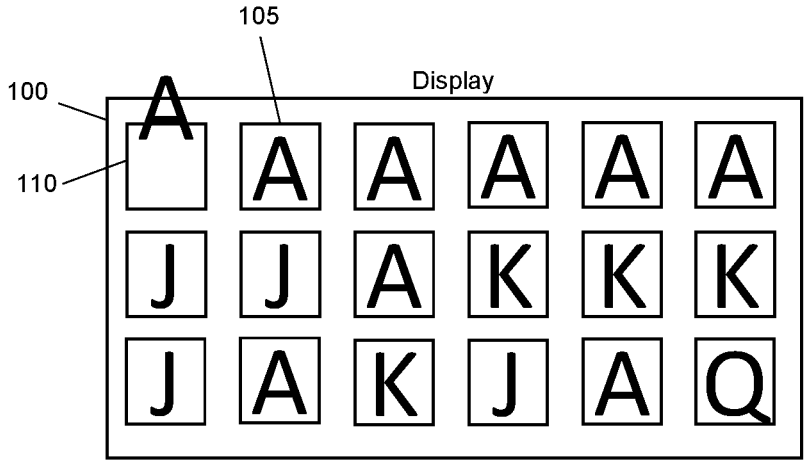
FIG. 1A illustrates a graphical user interface (GUI) matrix of symbols, in accordance with an example embodiment.

Various examples of systems, devices, and/or methods are described herein. Words such as "example" and "exemplary" that may be used herein are understood to mean "serving as an example, instance, or illustration." Any embodiment, implementation, and/or feature described herein as being an "example" or "exemplary" is not necessarily to be construed as preferred or advantageous over any other embodiment, implementation, and/or feature unless stated as such. Thus, other embodiments, implementations, and/or features may be utilized, and other changes may be made without departing from the scope of the subject matter presented herein.

Accordingly, the examples described herein are not meant to be limiting. It will be readily understood that the aspects of the present disclosure, as generally described herein, and illustrated in the figures, can be arranged, substituted, combined, separated, and designed in a wide variety of different configurations.

Further, unless the context suggests otherwise, the features illustrated in each of the figures may be used in combination with one another. Thus, the figures should be generally viewed as component aspects of one or more overall embodiments, with the understanding that not all illustrated features are necessary for each embodiment.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Moreover, terms such as "substantially," or "about" that may be used herein, are meant that the recited characteristic, parameter, or value need not be achieved exactly, but that deviations or variations, including, for example, tolerances, measurement error, measurement accuracy limitations and other factors known to skill in the art, may occur in amounts that do not preclude the effect the characteristic was intended to provide.

Throughout this description, the articles "a" or "an" are used to introduce elements of the example embodiments. Any reference to "a" or "an" refers to "at least one," and any reference to "the" refers to "the at least one," unless otherwise specified, or unless the context clearly dictates otherwise. The intent of using the conjunction "or" with a described list of at least two terms is to indicate any of the listed terms or any combination of the listed terms.

The use of ordinal numbers such as "first," "second," "third," and so on is to distinguish respective elements rather than to denote a particular order of those elements. For the purpose of this description, the terms "multiple" and "a plurality of" refer to "two or more" or "more than one."

Further, unless the context suggests otherwise, the features illustrated in each of the figures may be used in combination with one another. Thus, the figures should be generally viewed as component aspects of one or more overall embodiments, with the understanding that not all illustrated features are necessary for each embodiment.

i. Introduction

As noted above, memory requirements for rendering a GUI tend to increase as the number of elements to be rendered via the GUI increases. One example, in which this becomes apparent is in the gaming environment.

For example, modern slot machines can include a GUI that is configured to emulate a mechanical slot machine. The GUI can display one or more reels of randomly selected symbols. The arrangement of symbols can correspond to a matrix.

Referring to FIG. 1A, the GUI matrix 100 may depict six columns 105 and three rows 110 of symbols, for a total of eighteen symbols. The GUI matrix 100 may implement particular animation effects to simulate the spinning of one or more reels. Each row 110 of the matrix can correspond to a pay line. Different patterns of symbols within a particular row 110 can correspond to particular patterns, such as winning patterns. The score/payout associated with the different patterns can be different.

Figure 1B:
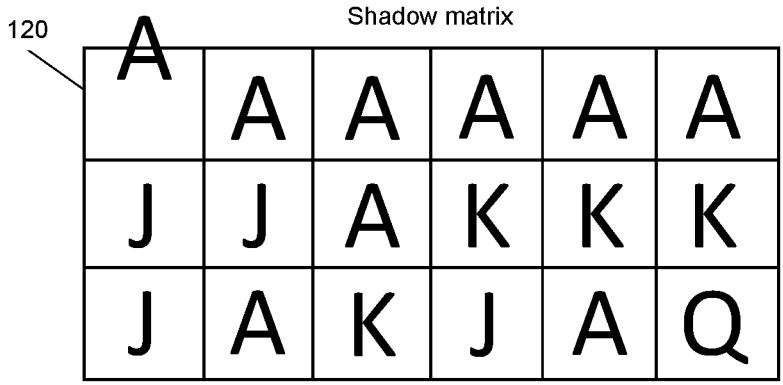
FIG. 1B illustrates a shadow matrix of the GUI matrix of FIG. 1A, in accordance with an example embodiment.
Figure 1C:
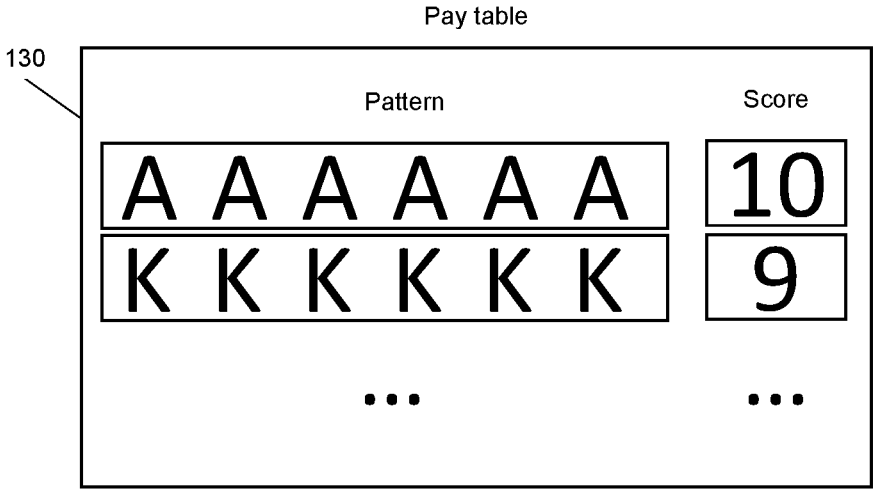
FIG. 1C illustrates a pay table for determining a score associated with a pattern of symbols represented in the shadow matrix of FIG. 1B, in accordance with an example embodiment.

Referring to FIG. 1B, a shadow matrix 120 that matches the GUI matrix 100 can be stored in the memory of the machine. And as shown in FIG. 1C, a pay table 130 that specifies scores associated with different pattern combinations can be stored in the memory of the machine. Together, the shadow matrix 120 and the pay table 130 facilitate determining the score associated with different patterns of symbols depicted in the GUI matrix 100.

In some instances, a user may not easily recognize the importance of certain symbols or patterns of symbols depicted in the GUI matrix 100. Therefore, it can be advantageous to emphasize important symbols and/or patterns and to de-emphasize less import symbols and/or patterns, which can improve user experience.

Figure 2A:
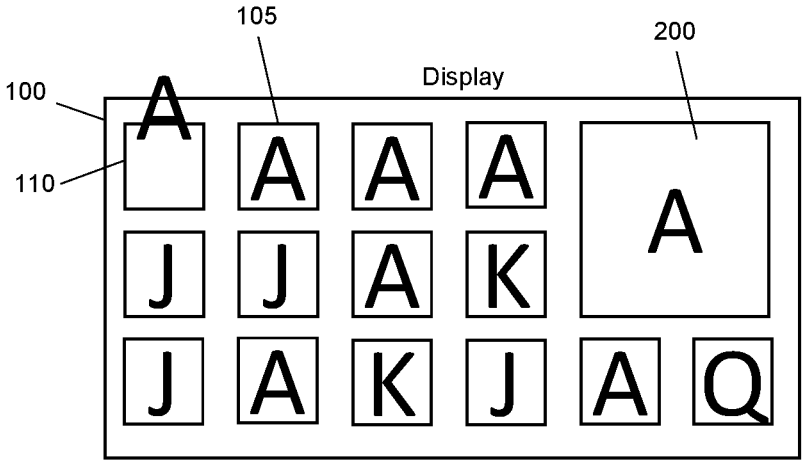
FIG. 2A illustrates the GUI matrix with an emphasized symbol, in accordance with an example embodiment.

FIG. 2A is an example of one way in which important symbols can be emphasized. As shown, an important symbol 200 can be depicted in a larger format so that the important symbol 200 overlap/covers less important symbols. Modification of the symbols in this manner can result in a change to the number of rows 110 and/or columns 105 of symbols depicted. That is, the size of the GUI matrix 100 can be changed.

Figure 2B:
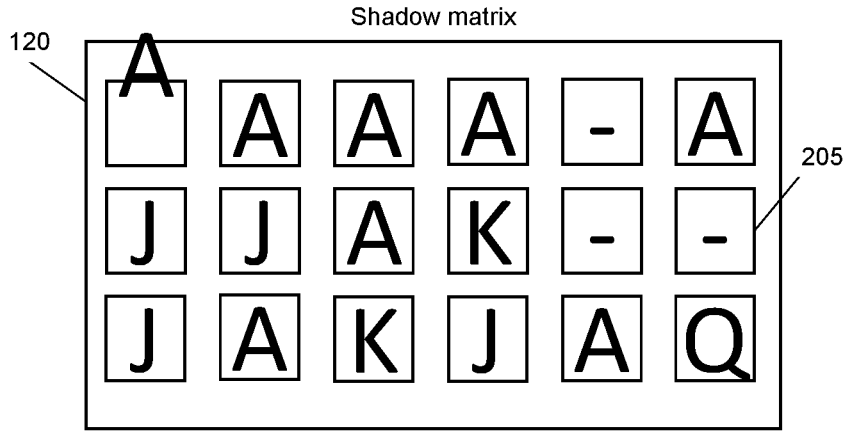
FIG. 2B illustrates a shadow matrix of the GUI matrix of FIG. 2A, in accordance with an example embodiment.

However, such modification can complicate determining a winning pattern. For example, as shown in FIG. 2B, the values of cells 205 of the shadow matrix 120 associated with the covered symbols of the GUI matrix 100 can be changed to indicate "don't care" conditions. But this can necessitate extra code logic to detect the "don't care" conditions.

Figure 2C:
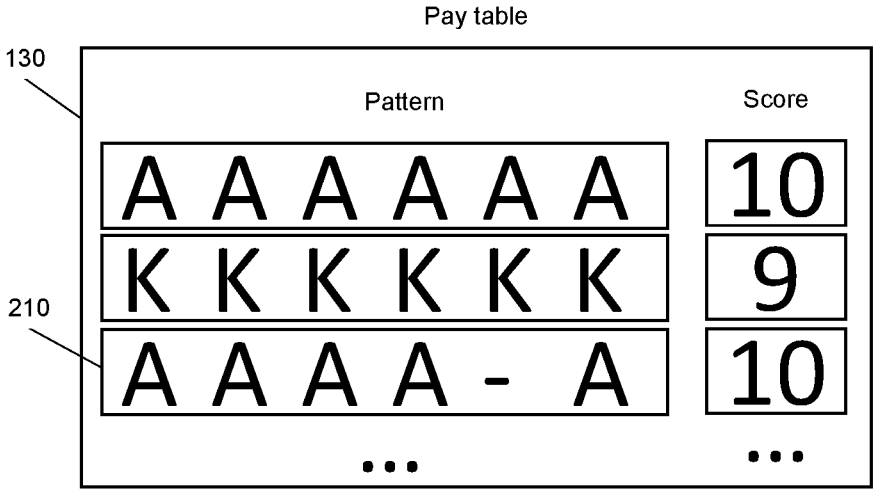
FIG. 2C illustrates an extended pay table for determining a score associated with a pattern of symbols represented in the shadow matrix of FIG. 2B, in accordance with an example embodiment.

Further, as illustrated in FIG. 2C, additional entries 210 may be required in the pay table 130 to associate patterns with the "don't care" conditions to scores. Adding the extra logic and the additional entries necessarily requires adding memory to the machine to accommodate the increased coding logic and the increased size of the pay table. This problem becomes more evident when one considers the number of pattern entries required to associate the various permutations of symbol patterns having "don't care" values with scores.

Described below are various example embodiments for configuring a GUI matrix and for organizing a shadow matrix in a way that obviates the need for providing additional code and pay table entries associated with the reconfigured GUI matrix. That is, the embodiments facilitate reconfiguring the GUI matrix without additional memory.

Generally, according to the examples, a GUI matrix is reconfigured to indicate the importance and value of a symbol by providing an enlarged symbol that covers multiple original symbol positions. The shadow matrix used to process a game result is reconfigured by copying the cell value associated with the important symbol to the cells associated with the symbols covered by the important symbol. This, in turn, facilitates using an existing pay table to determine winning patterns and the scores associated with the winning patterns. That is, the pay table does not have to be increased to accommodate the reconfigured GUI matrix. Thus, a more complicated pattern of symbols can be rendered via the GUI matrix without impacting memory requirements associated with the pay table.

As noted above, in the specification, the term matrix is used to describe an array, including columns and rows. Symbols are displayed in matrix positions where the columns and rows intersect. The columns represent reels of a mechanical slot machine. During a spin of the reels, and in a display shown to a user, columns of the matrix appear to move to simulate mechanical reel movement. As a result, the terms "column" and "reel" may be used interchangeably.

Each column, or reel, of the matrix has a reel strip associated therewith. A random number generator (RNG) is used to determine the part of the reel strip that is shown in the display, or, put in another way, which symbols will "land" on the display when the reels come to a halt after a spin.

When a trigger event occurs, a primary reel strip, associated with a primary reel, is modified so that the "stacking" of symbols thereon increases. "Stacking" refers to the groups or sets of symbols that are provided adjacent to each other on the reel strip. When symbols are provided on their own, i.e., not in groups, the stacking may be considered to be "one." This is the normal configuration, with symbols appearing on their own on the primary reel strip. An increase in the stacking of symbols on a reel strip results in groups of two symbols, i.e., a symbol will always appear adjacent to another identical symbol on the reel strip. A further increase in the stacking will result in groups of three symbols appearing adjacent to each other. The same applies for a stacking of four, five, and the like.

After an increase in the stacking of the primary reel strip, the primary reel is coupled to an uncoupled, adjacent secondary reel, and the primary reel strip is also applied to all coupled reels. The reels may then be spun again. The user may then be shown an oversized symbol that covers multiple original symbol positions. When a spin of the reels is simulated, the oversized symbol may appear to move as an enlarged reel, spanning the coupled reels.

When a termination event occurs, all coupled reels are uncoupled, the individual reel strips are reset to their original configuration, and the stacking of the primary reel strip associated with the primary reel is reset or removed.

A trigger event may be any win, as long as a maximum number of consecutive wins have not occurred. A termination event may be the absence of a trigger event, for example, when there is no win or when a win makes the maximum number of consecutive allowable wins.

In an example embodiment, a reel-based slot game may have an original configuration, and the layout of the visible matrix shown to the user is the same as that of a shadow matrix that is analyzed to process a game result. "Processing a game result" may include paying out a player for any win resulting from symbol positions in the shadow matrix.

A spin of the reels may then be initiated by a user, generally at the cost of a wager chosen by the user. When the reels come to a stop, a trigger event may occur. This may be any type of win when the total number of consecutive wins has not reached a predetermined maximum number. Then, some symbols shown to a user may be enlarged. For example, the symbols in the right-most column of the matrix (i.e., the right-most reel) may be enlarged. The enlarged symbols may then cover four of the original symbol positions, so that the new symbol extends across the last and second-to-last of the original columns, and across two adjacent rows of the visible matrix. A next spin, which may be a free spin provided to the user, may then show the enlarged symbols to spin as if they form part of a new, larger reel. The enlarged symbols may typically only be shown to a user once the next spin starts. The spin after the trigger event may be automatically initiated, without user input, and may then be considered a "free" spin without requiring a player to place a wager. The right-most reel may continue to grow in this manner for a maximum number of consecutive wins.

To allow the symbols shown to the user to grow while maintaining the same paytable operation, the shadow matrix used to calculate a win for the user is not identical to the one displayed to the user. Rather, when the appearance of a symbol is changed so that it appears larger on the display shown to the user, the shadow matrix is modified in the background. The stacking of a primary reel strip, associated with a primary reel, is increased so that symbols on the reel strip appear in groups of two. Then, the primary reel, possibly the rightmost reel, is coupled to an adjacent, uncoupled secondary reel. Then, the primary reel strip, associated with the primary reel, is also applied to all coupled reels. As a result, when the reels spin, the primary and secondary reels spin together, with the same symbols next to each other. The same symbols will, therefore, also land next to each other on the primary and secondary reel. In this configuration, an RNG may, therefore, only need to determine a single result for the first and second reel to land on, as they will move together. The larger symbols may only be shown to the user during a next spin, so that manipulation of the display provided to the user is done smoothly.

After each consecutive win, the same as above may occur, with another increase in stacking of the primary reel strip, an additional secondary reel being coupled to the primary reel, and the primary reel strip, associated with the primary reel, being applied to all coupled reels. The user may also see a larger symbol each time. It should, however, be noted that the enlarged symbols may have a maximum size, or, put in another way, there may be a limit to the number of consecutive wins that allow reels to be coupled to each other and have the same symbol layouts. The maximum size may be chosen by a game developer, but in general, it may be such that it extends across one column less than the total width of the matrix. In other words, a maximum of one less than the total number of reels may be linked together, and the maximum number of consecutive wins is one less than the number of reels on the display, with the last win then not being considered a trigger event. The reason for this is that if all columns were linked together, the user would receive a win on each spin in a game that pays from left to right because all the symbols within a particular row of the shadow matrix would be the same.

In a further example embodiment, a feature may be provided wherein the number of rows of the matrix is increased. As an example, a basic configuration may include three rows. When an activation event occurs, for example, the landing of a special symbol, two more additional rows may be activated, and which may be located immediately below the original three rows. This may, in turn, activate additional pay lines. The maximum number of rows, presently five, may be the same as the maximum size of any enlarged symbol. As the maximum size of a symbol may be one less than the total number of reels, this configuration may be appropriate for a normally three by six-slot game. As described above, the maximum width of a symbol may then be one less than the number of columns/reels, i.e., five. When two additional rows are activated, the entire symbol, five original columns wide and five original rows high, may be shown on the display.

When a trigger event leads to a free spin with any new, larger symbol appearance, any pay-out may be held over for when a termination event occurs, with a total win being shown or celebrated at the end of a sequence of wins.

When a termination event occurs, any coupled reels may be uncoupled, the individual reel strips may be reset to their original configuration, and any stacking may be reset. The visible matrix shown to the user may also be reset to the original condition, matching that of the shadow matrix used to process game results. A termination event may be when there is no win, or when the maximum number of consecutive trigger events has been reached.

ii. Example Architecture

Figure 3:
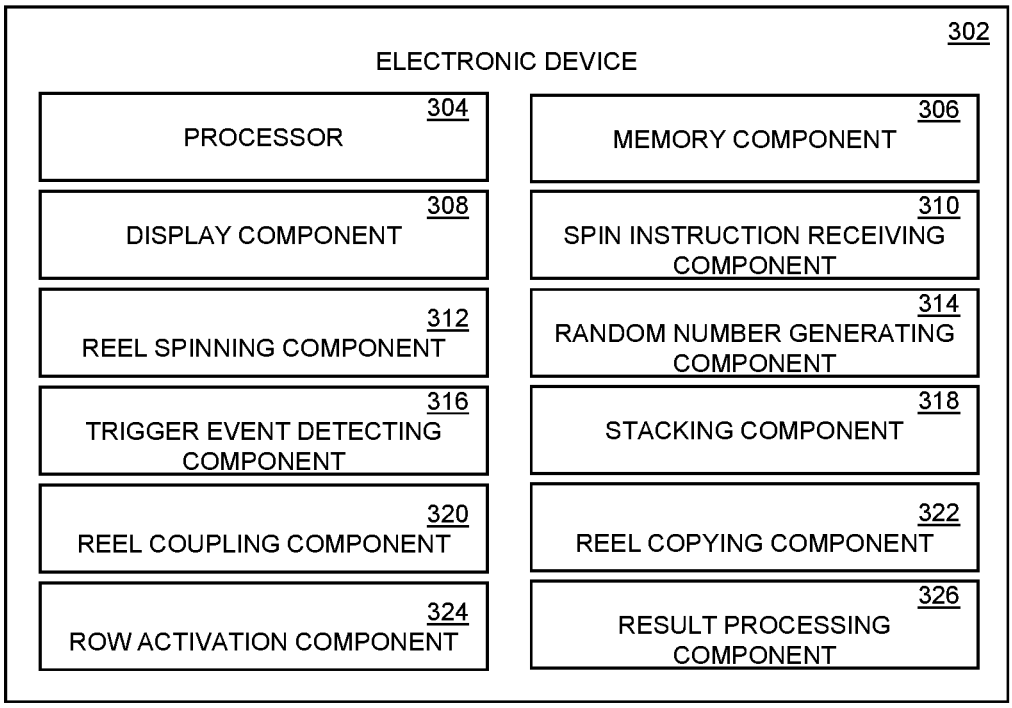
FIG. 3 is a simplified block diagram of an example electronic device, in accordance with example embodiments.

FIG. 3 is a block diagram depicting an example embodiment of an electronic device 302 configured to implement operations in accordance with various example embodiments described herein. The electronic device 302 may be a server hosting game aspects, a purpose-built gaming machine hosting game aspects, or the like.

The electronic device 302 can be configured to implement any of the methods described herein. In this regard, the electronic device 302 can include a processor 304 configured to perform various operations or assist other components in performing particular operations. In this regard, a memory component 306 can be in communication with the processor 304 and can store instruction code that is executable by the processor 304 to facilitate performing various operations by the processor. Within examples, the electronic device 302 can include a display component 308, a spin instruction receiving component 310, a reel-spinning component 312, a random number generating component 314, a trigger event detecting component 316, a stacking component 318, a reel coupling component 320, a reel strip applying component 322, a row activation component 324, and a result processing component 326.

The display component 108 may be configured to depict a GUI associated with the electronic device 302 or another electronic device, for example, an electronic device used by a user to participate in a game provided by the electronic device 302. The display component 108 may be used to depict, to the user, aspects of a game provided by the electronic device. This may include animations and a matrix of symbols that forms part of a reel-based slot game provided by the electronic device.

The spin instruction receiving component 310 may be configured to receive, directly or via another electronic device and from the user, a spin instruction. The spin instruction may be associated with a bet or wager.

The reel-spinning component 312 may be configured to, responsive to successfully receiving a spin instruction, spin reels of the reel-based slot game.

The random number generator (RNG) component 314 may be configured to generate random numbers, to select a random stop position for spinning reels. The RNG component 314 may form part of or may be at least partially managed by the processor 304.

The trigger event detecting component 316 may be configured to detect when a trigger event has occurred during gameplay. A trigger event may initiate certain actions, possibly managed by different components described below. When a trigger event does not occur, it may be considered a termination event. Accordingly, when the trigger event does not detect a trigger event, it may be considered a termination event. This is further described below.

The stacking component 318 may be arranged to, responsive to a trigger event, increase the stacking of symbols on a primary reel strip, associated with a primary reel, as further described below. It may further be configured to remove the stacking on a primary reel strip in response to a termination event.

The reel coupling component 320 may be configured to couple reels to each other, generally after a trigger event as described below. Coupled reels may be expected to move and land together. The reel coupling component 320 may be further configured to uncouple reels after a termination event.

The reel strip applying component 322 may be configured to apply a primary reel strip associated with a primary reel to any coupled reels, as described below. The reel strip applying component 322 may be further configured to reset any copied reels to their original condition.

The row activation component 324 may be configured to, responsive to an activation event, activate certain reels on the display, which may cause the additional reels to be displayed to the user and may also activate additional pay lines. The row activation component 324 may be further configured to disable any activated reels after, for example, a termination event.

The result processing component 326 may be configured to process a game result after a spin of the reels, or after a plurality of spins (for example after a sequence of spins incorporating multiple trigger events and terminating with a termination event). Processing a game result may include, for example, displaying a user's winnings, displaying celebration effects, displaying an update to the user's account balance, and the like.

It should be noted that the display component 108 may provide a specific visible matrix layout to a user, while the stacking component 318, reel coupling component 320, reel strip applying component 322, row activation component 324, and result processing component 326 may modify a "shadow" matrix used to determine a game result. This is further described below.

iii. Example Operations

Figure 4:
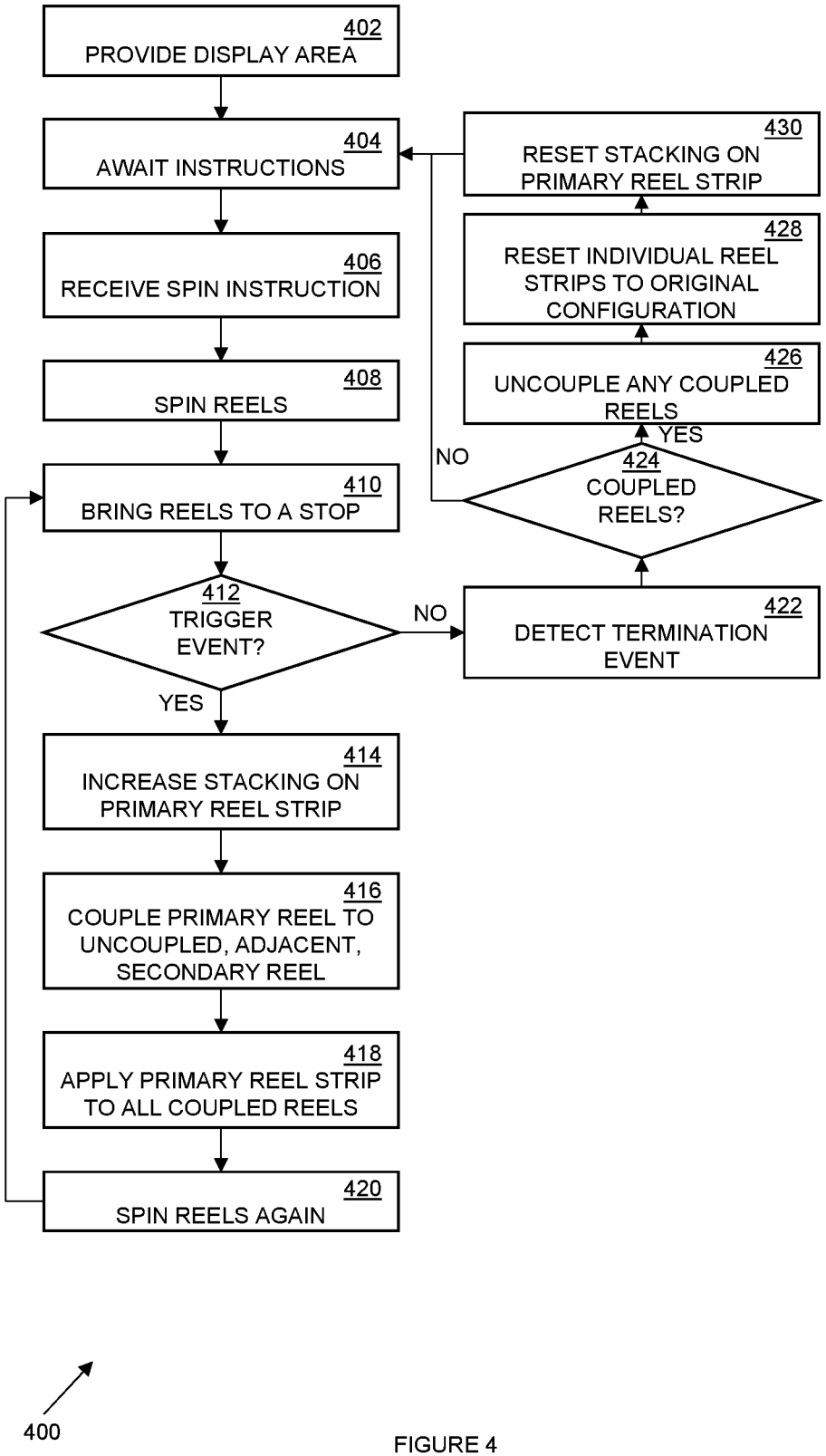
FIG. 4 is a flow diagram, in accordance with example embodiments.

FIG. 4 depicts a flow diagram 400 that illustrates an example method that may be carried out using an electronic device, such as the electronic device 302 of FIG. 3. Operations of the method are shown within blocks 402 to 430. The example method can relate to modifying a matrix configuration. Any operation described below, or elsewhere in this description, with respect to FIG. 4, can be performed, at least in part, by a processor, such as the processor 304 executing software program instructions. In the embodiment detailed by the present flow diagram 400, the electronic device may detect a trigger event, after which the configuration of a shadow matrix associated with a pay table used to process payments for play of the game will be modified as per the detailed explanation below. "Shadow" in this context means not visible to a player. The appearance of the GUI/visible matrix, shown to the user, can be modified as appropriate at the same time. A maximum number of consecutive trigger events may be allowed, and when the maximum is reached or when a trigger event is not detected, a termination event can be detected. This can reverse modifications made to the shadow and GUI/visible matrixes.

Block 402 includes providing, by the electronic device and for display to a user, a display area. Aspects of a game may be displayed in the display area. The display area may be provided to the user either directly by the electronic device 302 or may be provided on a display of another electronic device, for example, an electronic device of the user on which the user participates in the method provided by the electronic device 302 and in data communication therewith.

Block 404 includes awaiting instructions to proceed with the method.

Block 406 includes receiving a spin instruction, generally from the user, either directly, or via an input device of another electronic device. The input device may be, for example, a touch-screen user interface of a mobile device via which the user participates in the method and on which the display area is provided to the user.

Block 408 includes spinning reels of the reel-based slot game, and block 410 includes bringing the reels to a stop. The stop position of the reels may be determined by an RNG, for example, an RNG forming part of the RNG component 314 of FIG. 3. At an initial stage, the shadow matrix used to determine a game result and the GUI/visible matrix shown to a user can have the same configuration.

Block 412 includes detecting whether a trigger event has occurred. Example steps that can be performed when a trigger event has occurred are as follows: A trigger event may correspond to any win event that has occurred after a spin of the reels, so long as a maximum number of consecutive trigger events have not yet occurred. If, for example, a trigger event is any win, and the maximum number of consecutive trigger events is four, a fifth consecutive win may be allowed. However, the win will not be considered a trigger event. As a result, after a fifth consecutive spin a termination event will be detected, irrespective of the result of the fifth spin. As the maximum number of four consecutive trigger events have already occurred, a fifth consecutive win will be considered a termination event.

If a trigger event has occurred, the method moves on to block 414. Block 414 includes increasing the stacking on a primary reel strip, associated with a primary reel, of the shadow matrix. An example of the primary reel can be a right-most reel on the display. In other examples, the primary reel can be specified by an operator or configurator of the specific game.

Block 416 includes coupling an uncoupled, adjacent, secondary reel of the shadow matrix to the primary reel. This ensures that the primary and secondary reels, now coupled together, will move with each other and land together.

Block 418 includes applying the primary reel strip to all coupled reels of the shadow matrix. This ensures that the same symbol will land next to itself, i.e., on the same row on all coupled reels.

Block 420 includes spinning all the reels again. All coupled reels of the shadow matrix will then have the same symbols next to each other on the same row and, depending on the extent of the stacking, also on some of their columns. This is further detailed below. Uncoupled reels will still land on randomly determined positions. The method then moves back to block 410, where the reels are brought to a stop. A trigger event may then again be detected at block 412, and the operations between blocks 414 and 420 may repeat so long as a maximum number of consecutive trigger events has not been reached.

According to the operations above, the shadow matrix is reconfigured by duplicating cells within the primary reel and copying the cell values from the primary reel to adjacent cells.

While the stacking, coupling, and applying described above are done to the shadow matrix, the display component of the electronic device may update the GUI/visible matrix provided to the user in an appropriate way, for example so that symbols appear to grow and so that they extend across multiple original symbol positions. That is, the symbols appear to grow while the structure of the shadow matrix (i.e., number of columns and row) can remain the same. This, in turn, can facilitate using an existing pay table to determine winning patterns and the scores associated with the winning patterns. That is, the pay table does not have to be increased to accommodate a more specialized shadow matrix specifically configured to match the reconfigured GUI/visible matrix. Thus, a more complicated pattern of symbols can be rendered without impacting memory requirements associated with the pay table.

Should a trigger event (e.g., a winning combination of symbols) not be detected at block 412 or, for example, the number of consecutive wins exceeds a threshold, operations may proceed to block 422.

Block 422 includes detecting a termination event. A termination event may, therefore, be that a win has not occurred, or that a maximum number of consecutive trigger events (e.g., wins) have occurred. When a trigger event corresponds to a win that occurs after bringing the reels to a stop, the maximum number of consecutive wins may be five. In examples, after a fifth consecutive win, the method will not proceed to block 424, but rather to block 422.

Block 424 includes checking if there are any coupled reels. If there are, the method moves to block 426.

Block 426 includes uncoupling any coupled reels of the shadow matrix.

Block 428 includes resetting any individual reel strips to their original configuration, and block 430 includes resetting the stacking on the primary reel strip. As above, the display component may update the visible matrix shown to a user so that any enlarged symbols may return to a normal size and position.

If at block 424, it is detected that there are no coupled reels, the method may move back to block 404, where the electronic device may await instructions.

At the time that a termination event is detected, a game result may be processed. The result may incorporate any wins from consecutive trigger events, possibly wins, if applicable.

FIGS. 5A and 5B illustrate examples of operations that can be performed in addition to the operations performed in FIG. 4 when a row activation event occurs during gameplay. Block 410, shown in FIG. 5A may be reached as described with reference to FIG. 4 above. Block 511 includes detecting an activation even after the reels come to a stop in block 410.

If an activation event occurs, additional rows are activated in block 513. This increases the size of the shadow matrix used to determine and process a win for the user and the size of the visible matrix shown to the user. Along with the increase in the shadow matrix, additional pay lines may be activated, which may increase a user's likelihood of winning. Then, the method may proceed to block 412 (described above), where a trigger event may be detected. If no activation event occurs, the method may proceed to block 412 from block 511.

From block 414, the method may proceed as described with reference to FIG. 4 above.

As illustrated in FIG. 5B, block 422 may be reached as described above with reference to FIG. 4. Block 523 includes, after detecting a termination event at block 422, checking whether any additional rows have previously been activated. If additional rows are active, the method may proceed to block 525, where the additional rows of the shadow and GUI/visible matrixes may be deactivated. The method may then proceed to block 424, where the method determines if there are any coupled reels. If no additional rows are found to be active in block 523, the method may proceed directly to block 424.

From block 424, the method may proceed as described with reference to FIG. 4 above.

Any of the blocks of a flow diagram or a component in a block diagram may be provided by hardware or by software associated with the electronic device. The electronic device may correspond to a personal computer, laptop computer, personal digital assistant, smartphone, feature phone, satellite phone, server computer, phablet, tablet, wearable computer, stand-alone gaming device, or the like. Appropriate components may form part of such a device for the operation of the required method on that device. Further, the electronic device may be configured to communicate wirelessly or over a wired communication network to another electronic device. The various components forming part of each electronic device may be configured to communicate with each other via an appropriate communication interface, while an appropriate external communication interface may facilitate communication with other electronic devices, whether forming part of the present systems or not.

Notably, the features of modifying a shadow matrix used to process a game result by stacking symbols on a primary reel strip associated with a primary reel, coupling some reels with the primary reel, and applying the primary reels trip to all coupled reels, allows the shadow matrix used to process a game result to be used as is, and without changes to pay lines. As noted above, this results in memory savings because additional pay lines are not required to be added to the pay table. At the same time, a GUI/visible matrix may be displayed to a user with enlarged symbols that cover the positions of duplicate symbols represented in the shadow matrix. In this manner, a user may be made aware of their increased likelihood of winning a prize or may be informed of the increased value of the enlarged symbol in an easily recognisable manner on the visible matrix. This may drive up player excitement, leading to an enhanced playing experience. As a symbol enlarges on the display, possibly over multiple rounds, user anticipation may be heightened. This may lead to a further improved experience to the user, while potentially complex changes to pay tables and pay lines to accommodate a shadow matrix exactly matching that shown to the user is therefore avoided, thus saving memory of the electronic device.

Figure 6A:
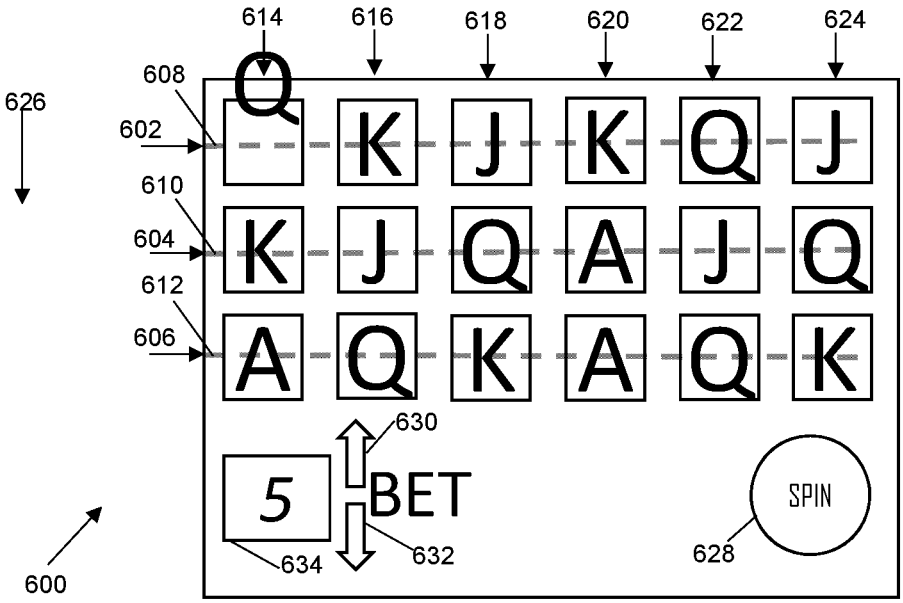
FIG. 6A illustrates a first configuration of reels, in accordance with a first example embodiment.
Figure 6B:
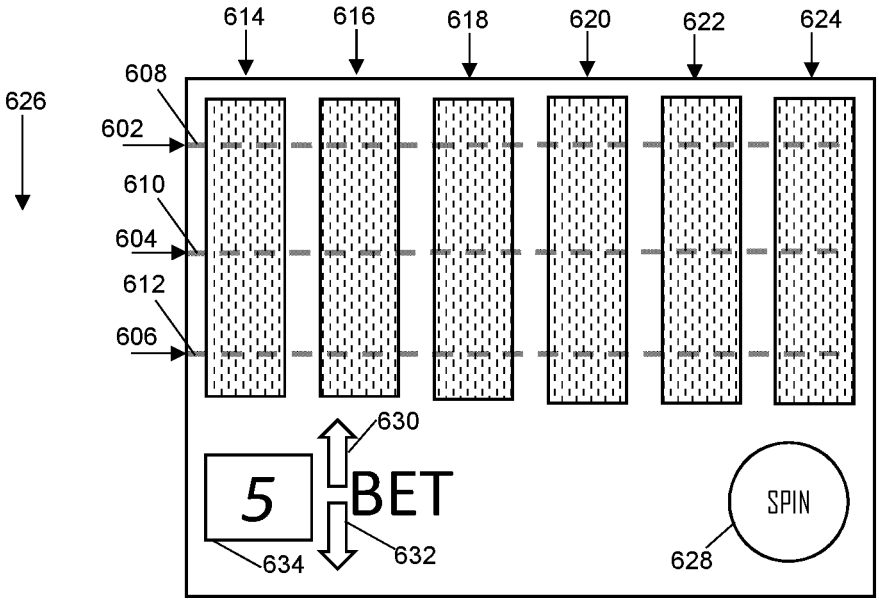
FIG. 6B illustrates a second configuration of reels, in accordance with the first example embodiment.
Figure 6C:
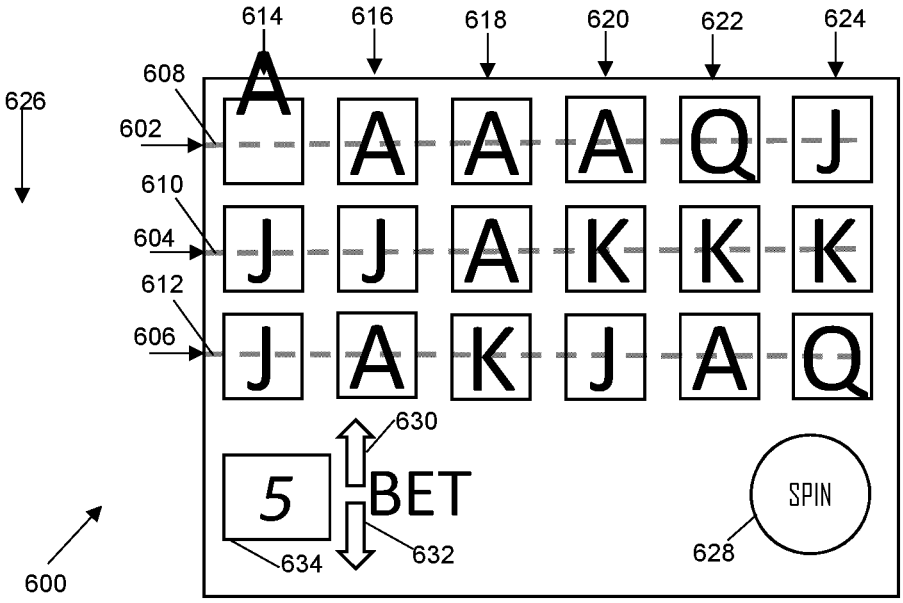
FIG. 6C illustrates a third configuration of reels, in accordance with the first example embodiment.
Figure 6D:
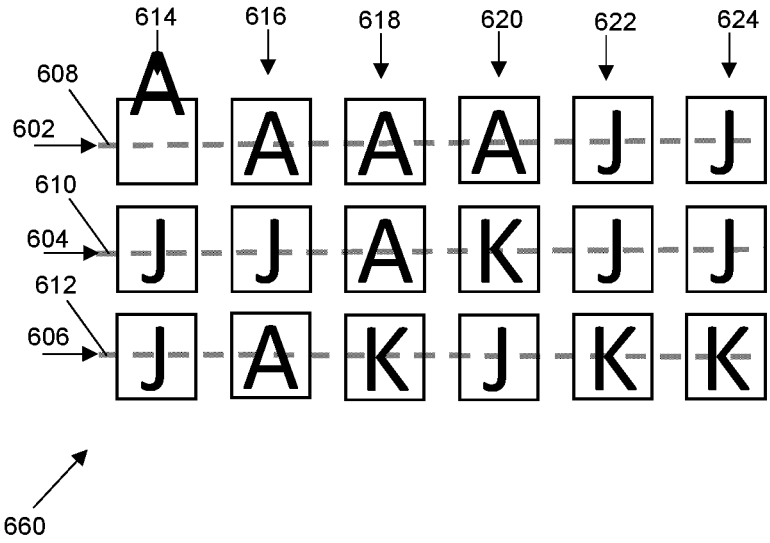
FIG. 6D shows a first representation of a matrix used to process a game result, according to the first example embodiment.
Figure 6E:
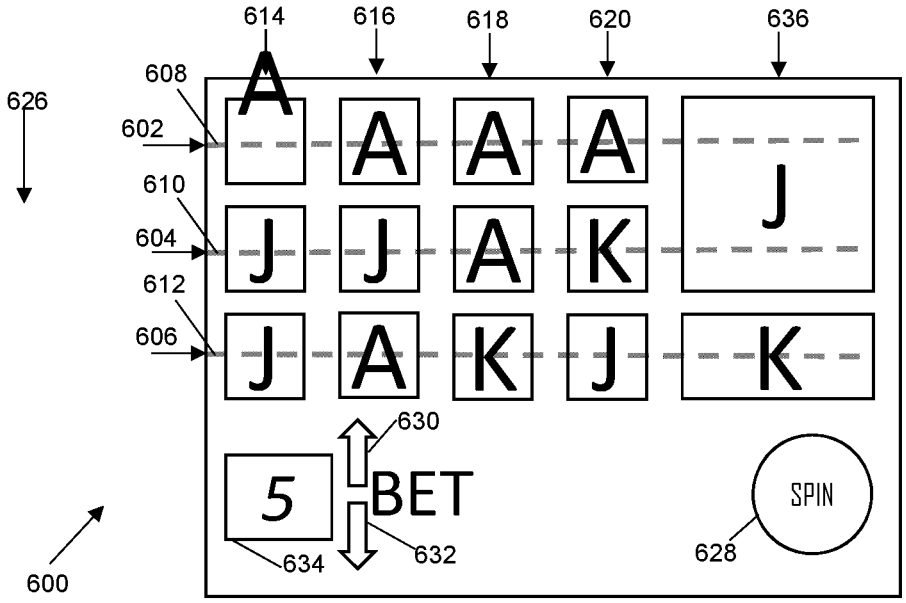
FIG. 6E illustrates a fourth configuration of reels being associated with the matrix of FIG. 6D, in accordance with the first example embodiment.
Figure 6F:
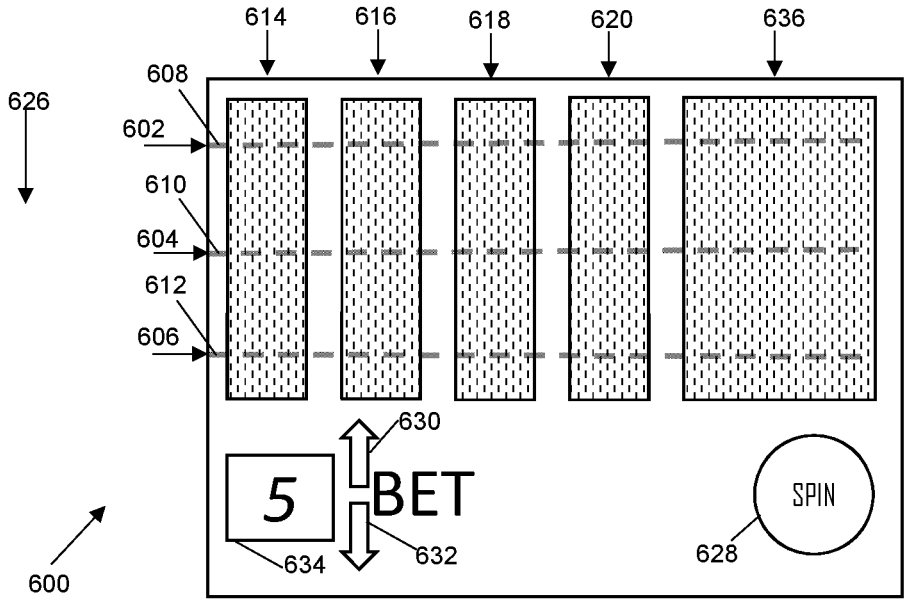
FIG. 6F illustrates a is a fifth configuration of reels, in accordance with the first example embodiment.
Figure 6G:
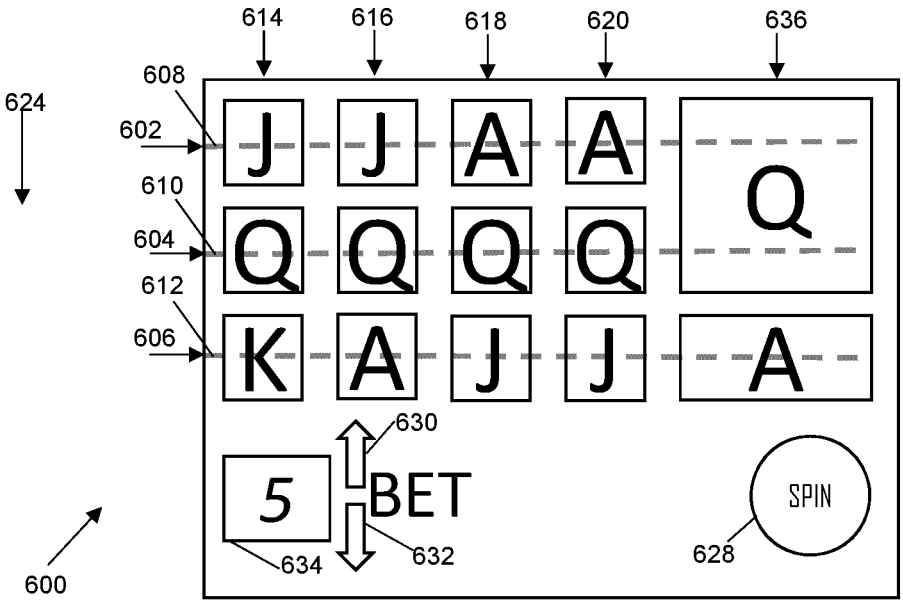
FIG. 6G illustrates a sixth configuration of reels, in accordance with the first example embodiment.
Figure 6H:
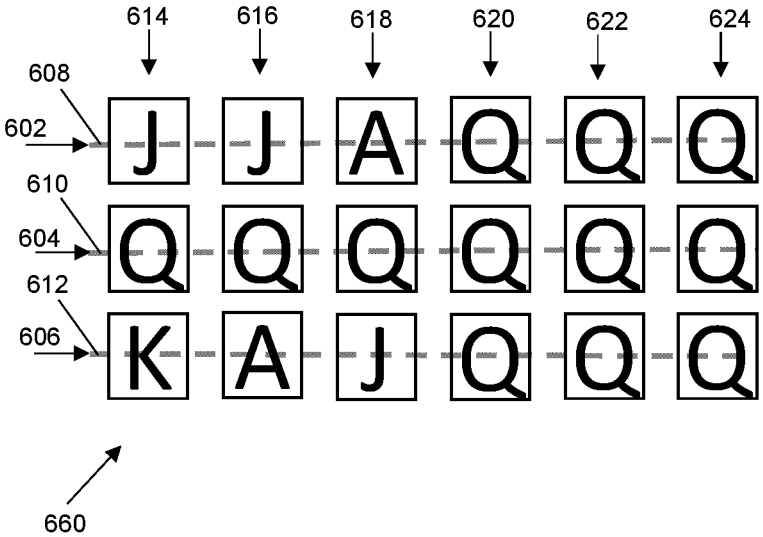
FIG. 6H shows a second representation of a matrix used to process a game result, in accordance with the first example embodiment.
Figure 6I:
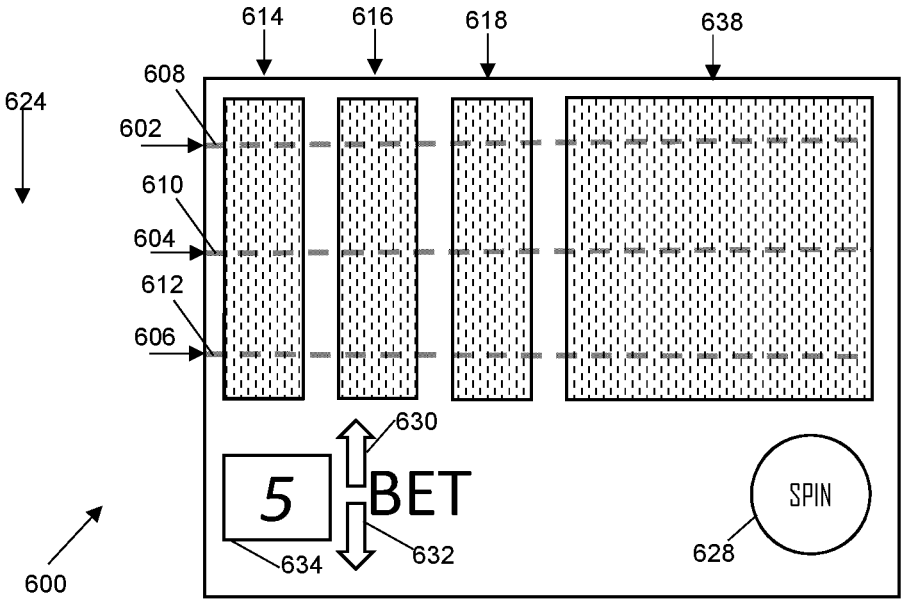
FIG. 6I illustrates a seventh configuration of reels, in accordance with the first example embodiment.
Figure 6J:
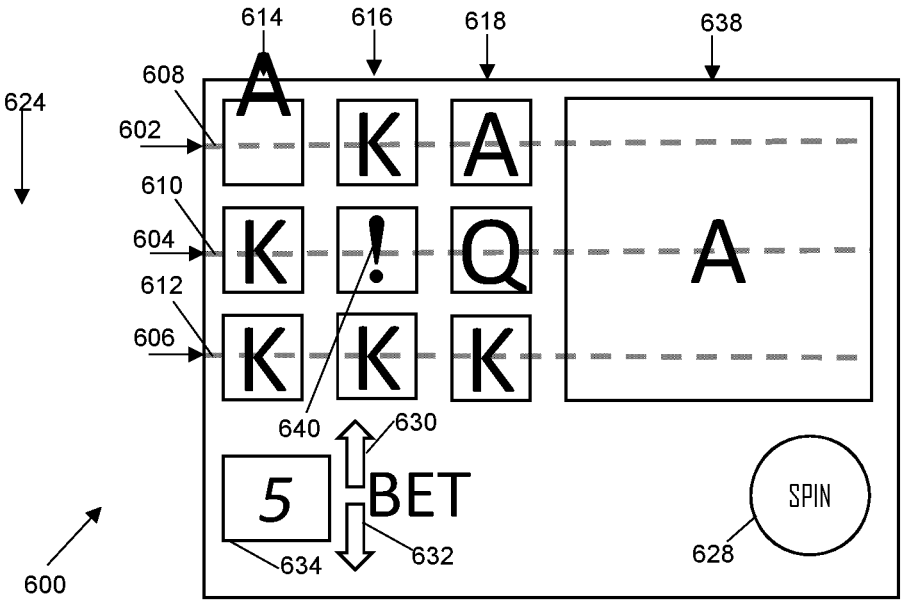
FIG. 6J illustrates an eighth configuration of reels, in accordance with the first example embodiment.
Figure 6K:
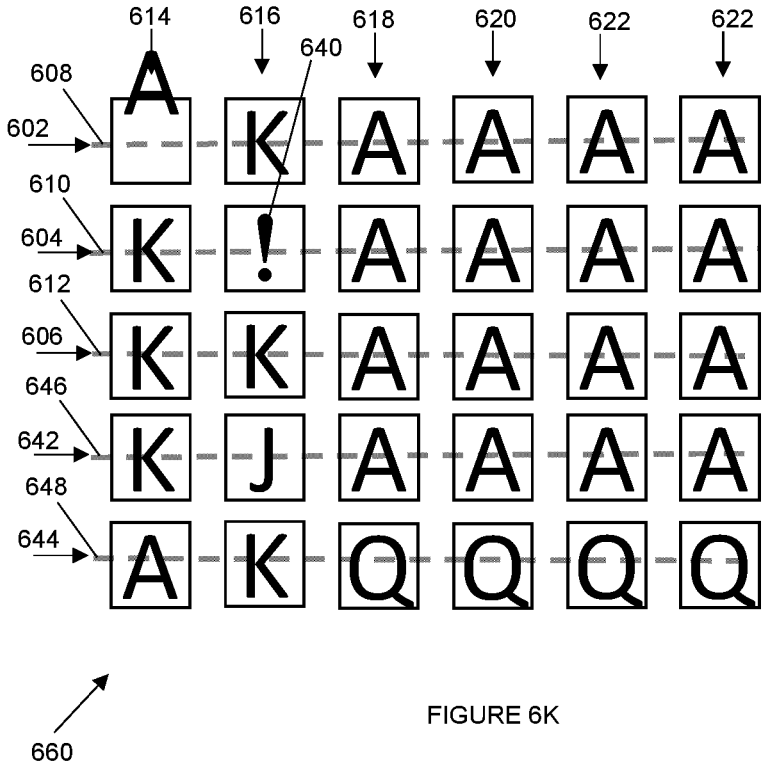
FIG. 6K shows a third representation of a matrix used to process a game result, in accordance with the first example embodiment.
Figure 6L:
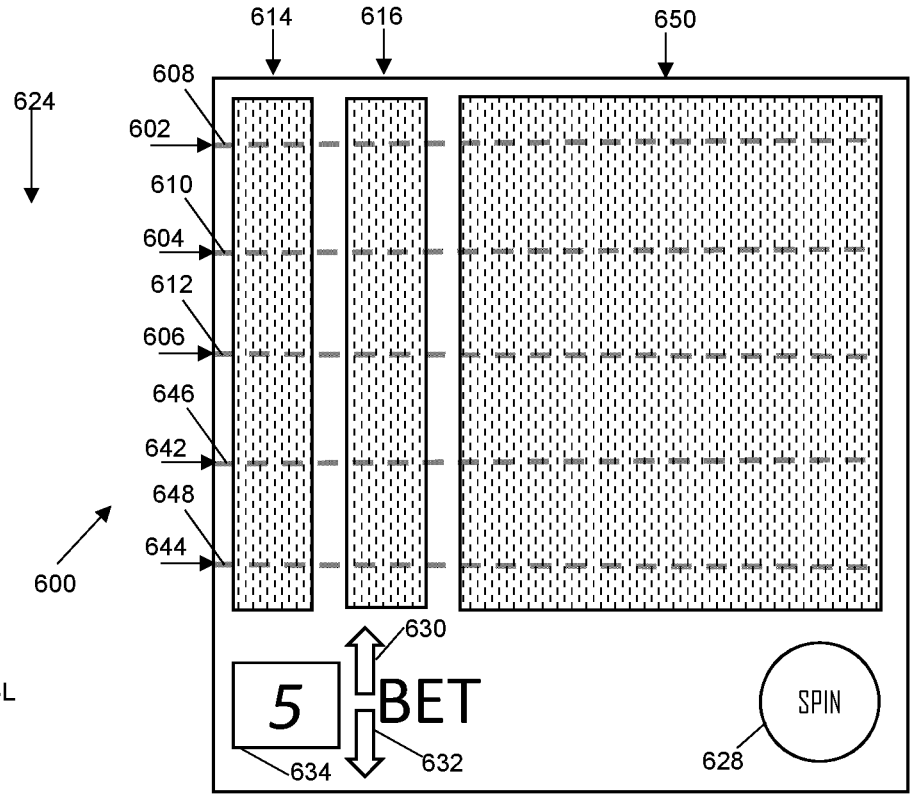
FIG. 6L illustrates a ninth configuration of reels, in accordance with the first example embodiment.
Figure 6M:
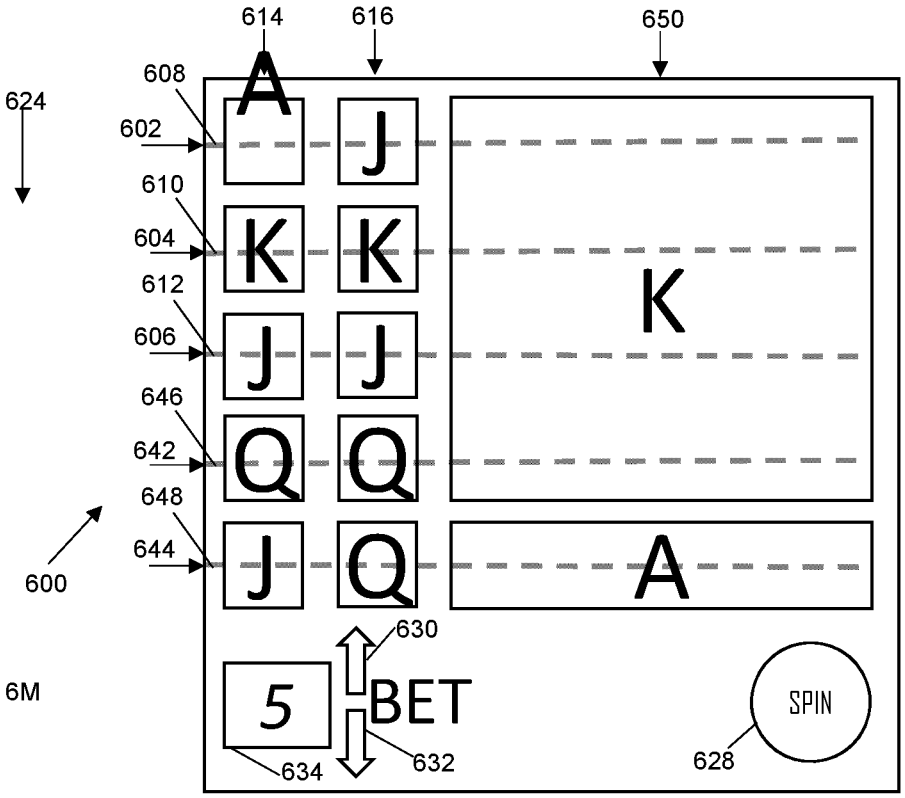
FIG. 6M illustrates a tenth configuration of reels, in accordance with the first example embodiment.
Figure 6N:
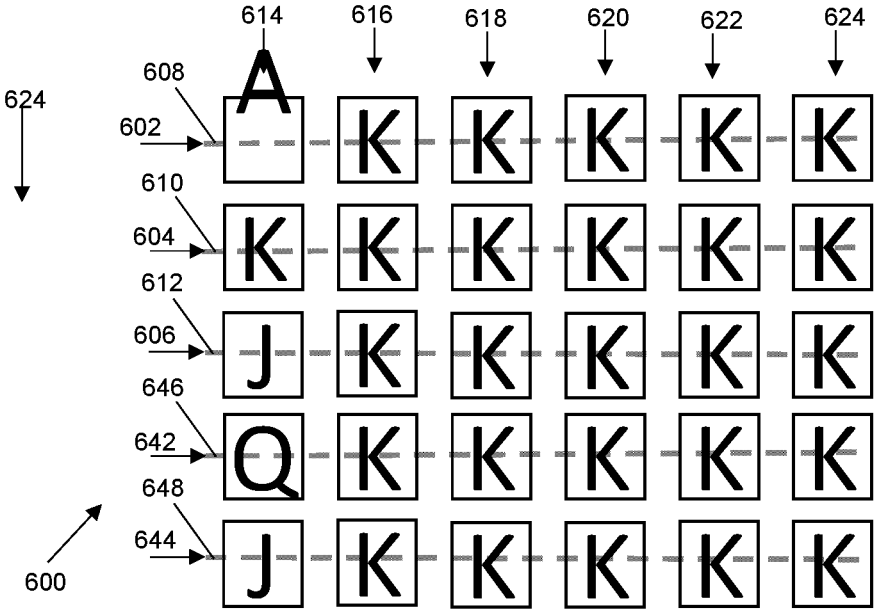
FIG. 6N shows a fourth representation of a matrix used to process a game result, in accordance with the first example embodiment.
Figure 6O:
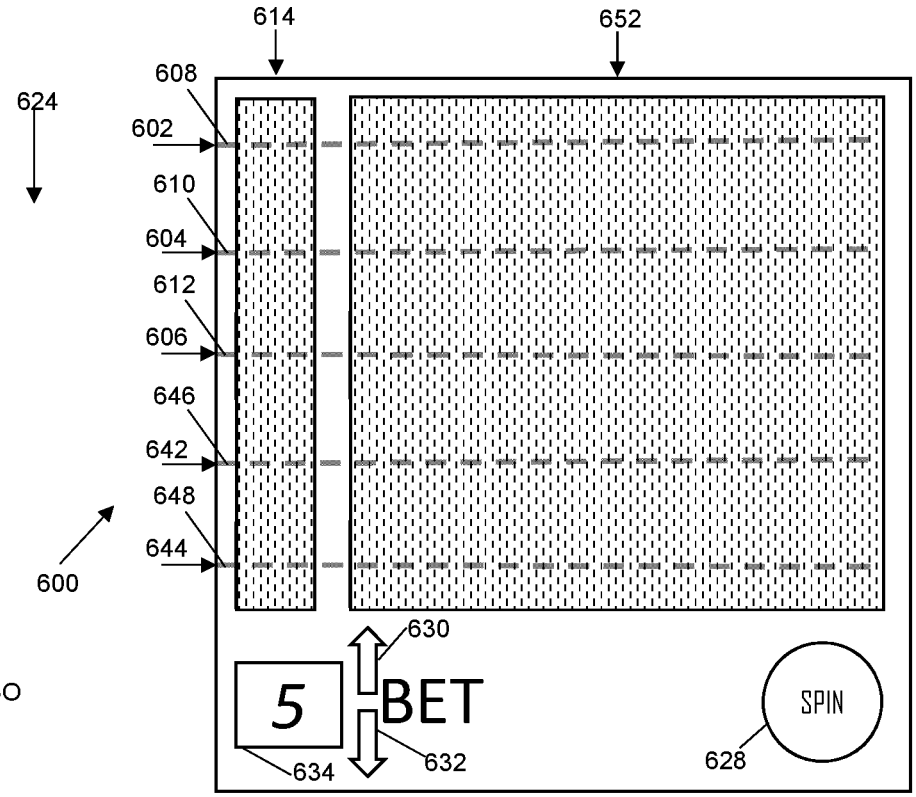
FIG. 6O illustrates an eleventh configuration of reels, in accordance with the first example embodiment.
Figure 6P:
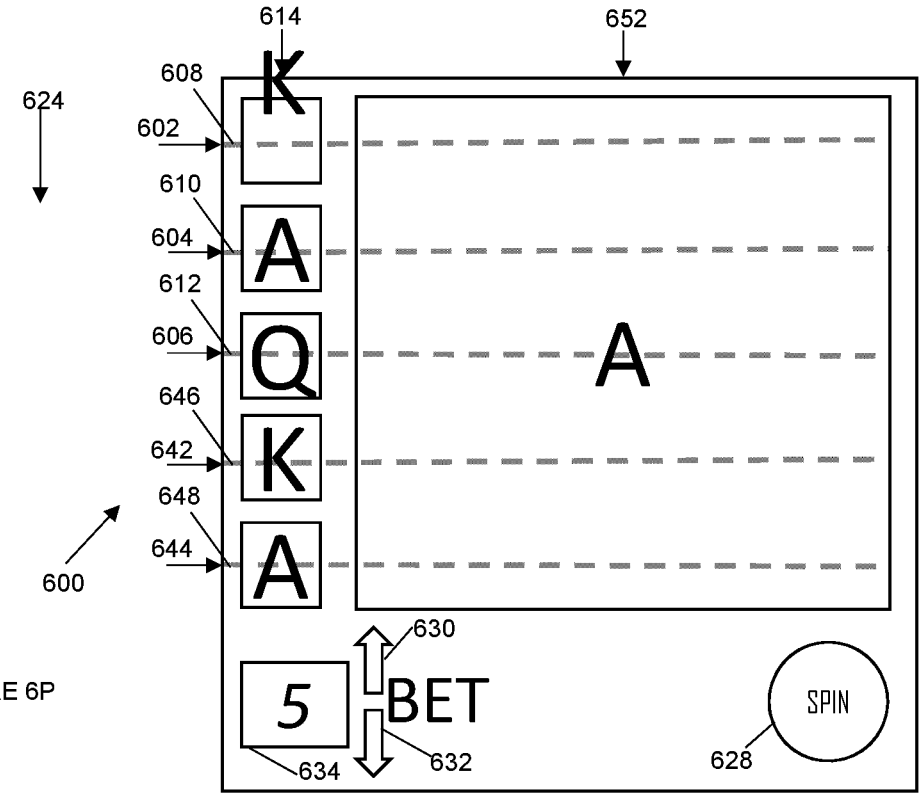
FIG. 6P illustrates a twelfth configuration of reels, in accordance with the first example embodiment.
Figure 6Q:
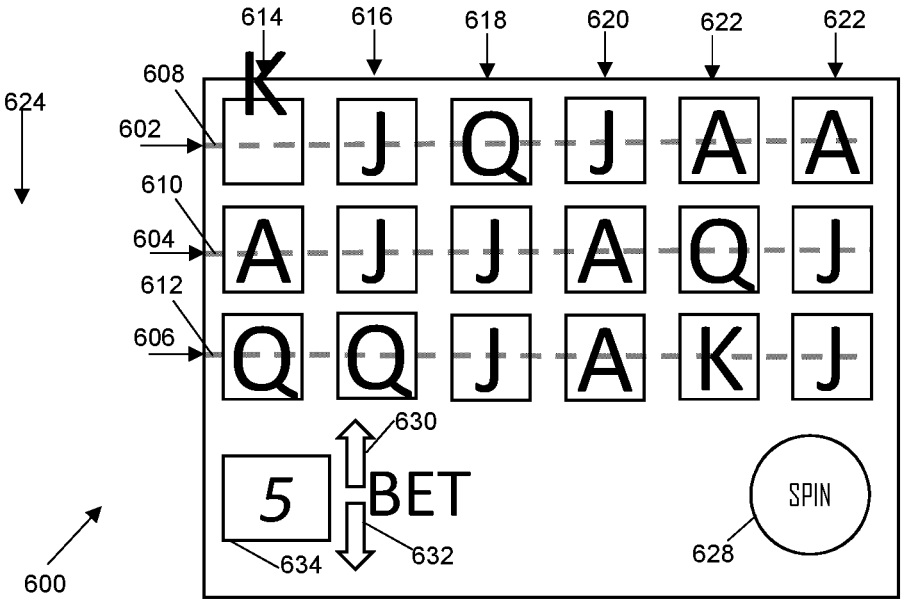
FIG. 6Q illustrates a thirteenth configuration of reels, in accordance with the first example embodiment.

FIGS. 6A to 6Q illustrate various configurations of reels that can be depicted on a display. For example, the various configurations can be rendered via a graphical user interface (GUI) of the computer system. An example of the computer system can correspond to a gaming machine that can include a gaming machine display (600). Within examples, the various configurations of reels can be associated with a game. A shadow matrix (660) can be used to process a game result and associated with the gaming machine display (600). Like reference numerals on FIGS. 6A to 6Q represent like features and components. This example is one implementation where a first spinning instruction is provided by a user, and a second and further spinning instruction may be generated by the gaming machine itself in response to a specific game result, typically a trigger event.

To simplify the description of the present embodiment, only four different base symbols are included in the matrix, notably Jacks (depicted by a "J"), Queens (depicted by a "Q"), Kings (depicted by a "K"), and Aces (depicted by a "A"). Special activation symbols, as further explained below, are also provided. It will be apparent that many different types of symbols may be provided, as may be selected by a game developer.

FIG. 6A shows a display (600) of an electronic device, as presented to the user. The display 600 is shown in a random state at the start of the game. The example game of the present embodiment may be referred to as a "six reel" slot game having three pay lines. A matrix of symbols is provided on the display. Three rows are provided in the matrix, as well as six columns, providing a six by three matrix. A pay line is provided on each of the three rows of the matrix. The first, second, and third rows are numbered 602, 604, and 606, respectively. Pay lines 608, 610, and 612 are associated with rows 602, 604, and 606, respectively.

The first column is indicated by numeral 614, the second by numeral 616, the third by numeral 618, the fourth by numeral 620, the fifth by numeral 622, and the sixth by numeral 624. A movement direction of the symbols is shown by a directional arrow 626.

A spin button 628 is provided, which may be selected by a user to provide a spin instruction and initiate movement of the symbols in a direction corresponding to the directional arrow 626. A first arrow button 630 allows a user to increase the size of a bet or wager on a game, possibly to a maximum level, and a second arrow button 632 allows a user to reduce the size of the user's bet. The bet level 634 is also shown to a user and is currently five credits.

The buttons may be physical buttons associated with an electronic device in the form of a gaming machine or may be provided on a touch-sensitive display screen, where the buttons may be selected by a user. Alternatively, a pointing device such as a computer mouse may be used to select the buttons when applicable.

The matrix shown in FIG. 6A is part of the display and is a visible matrix shown to the user. A shadow matrix, used to process a game result, may operate in the background. With the configuration shown in FIG. 6A, the shadow matrix matches the visible matrix.

Turning now to FIG. 6B, a user may select the spin button 628 to start the game at a selected bet level. Selecting the spin button 628 provides a spinning instruction to the electronic device, and movement of the symbols is simulated on the display, as shown in FIG. 6A. The symbols appear to move in the movement direction, corresponding to the directional arrow 626. As a result, the symbols appear to move downwards on the display and along the columns of the matrix. This mimics the movement of reels traditionally seen on a mechanical slot machine.

The electronic device managing the systems and methods of the present embodiment includes multiple virtual reel strips that are each associated with one of the columns in the configuration of FIGS. 6A and 6B. A random number generator determines which positions of the relevant virtual reel strip will be shown on the columns when the reels come to a stop.

Moving now to FIG. 6C, the movement of symbols has stopped, with the symbols shown in positions determined by the random number generator on the display in the visible matrix. The visible matrix of FIG. 6C still corresponds to the shadow matrix used to process a game result. In the present embodiment, payment occurs for three or more adjacent symbols on any one of the three pay lines (608, 610, 612), starting from the left. The more adjacent symbols, the higher a pay-out. Pay-outs may be defined in a paytable associated with the game, which may be available to a user. A pay-out may be influenced by the size of the user's bet or wager placed on a bet. In FIG. 6C, the first four positions of the first pay line (608) are Ace symbols, leading to a win for the user. In the present embodiment, any win without the maximum number of consecutive wins being reached is a trigger event. Accordingly, the win shown in FIG. 6C is recognized as a trigger event, as no previous wins have occurred.

Now, after the trigger event, the shadow matrix used to process a game result, and the matrix shown to the user, may be reconfigured. This is done by first increasing stacking on a primary reel strip, associated with a primary reel, of the shadow matrix. Presently, the "primary" reel that is modified in this way is the rightmost reel, or the sixth reel, associated with column 624. "Stacking" in this context results in the same symbol in two consecutive positions on a reel strip associated with the specific column, as detailed above.

Moving then to FIG. 6D, the trigger event described above with reference to FIG. 6C results in the modification of the shadow matrix 660 used to process a game result. FIG. 6D shows the shadow matrix 660 after its modification. It should be noted that the shadow matrix 660 shown in FIG. 6E does not include the bet buttons, spin button, or credit indicator, because the shadow matrix 660 is an in-memory representation of the symbols depicted in the display 600 and not the other elements that may be depicted on the display 600.

For illustrative purposes, FIG. 6D may be compared to FIG. 6C, while its modification is described. In FIG. 6C, the symbol in row 602, column 624, is a Jack. As FIG. 6C shows the original layout of the visible matrix, it is still the same as the shadow matrix, and the same column and row numbers may be used to describe the columns and rows of FIG. 6D. Column 624 is considered a primary reel in the present embodiment, and a primary reels trip is associated therewith. The symbols on the primary column 624 are stacked, resulting in the same Jack symbol now also appearing in row 604, column 624 of the shadow matrix 660. The symbol in row 604, column 624, was a King in FIG. 6C. Now, in FIG. 6D the symbol is shown at row 606, column 624. The first symbol on the primary reel strip not shown in FIG. 6D, i.e., the symbol below the visible King on the primary reel, is also a King, as the King symbol would also be stacked. All symbols on the primary reel will now appear in groups of at least two.

Further, the primary reel (as identified above, associated with column 624) is coupled to an uncoupled, adjacent, secondary reel. In the present embodiment, the uncoupled reel adjacent the primary reel is the fifth reel, being associated with column 622. The fifth reel may, therefore, be considered the secondary reel. Now, the fifth reel will turn with and land with the sixth reel. In addition, the primary reel strip is applied to the secondary reel. Accordingly, the fifth and sixth reels are now identical and will turn and land together. A symbol that lands on the fifth reel in column 622 will, therefore, land also immediately next to it on the sixth reel in column 624. A Jack symbol is shown on row 602, columns 622 and 624, and on row 604, columns 622 and 624. A King symbol is shown in row 606, columns 622 and 624. The Jack symbols form a group of four symbols.

It should be noted that this description of stacking symbols, coupling reels and applying reel strips with reference to FIG. 6D need not happen as shown, wherein the symbols that landed in a previous spin, as shown in FIG. 6C, are stacked, coupled, and applied based on their previous positions. Typically, the new configuration will only be used during the next spin of the reels, with a position being assigned according to an RNG result. It should be noted that a new virtual reel may be used for at least the primary reel after re-configuration of the matrix, with the reel then also copied to the fifth reel, with the fifth and sixth reels then being coupled together during a future spin.

While the user will not see the shadow matrix 660 shown in FIG. 6D, a display 600 associated with the shadow matrix configuration of FIG. 6D may be that shown in FIG. 6E. This is again shown for illustrative purposes and need not be presented to a user during gameplay. It is shown to indicate an association between the shadow/hidden and the visible matrixes.

The fifth column 622 and sixth column 624, as still used in the shadow matrix 660, have been replaced by a single, larger column 636. Instead of showing the four individual Jacks in row 602, columns 622 and 624, and on row 604, columns 622 and 624, as per the shadow matrix 660 of FIG. 6D, the user is shown a much larger Jack symbol that covers all four positions previously occupied by 602, column 624, and row 604, column 624 of the display. Similarly, part of a larger King symbol is shown over the two positions previously occupied by the two King symbols in row 606, columns 622 and 624. Only a part of the King symbol is shown, and it appears to a user that the symbol is cut off, with the rest of the symbol being off the display. It may appear to a user that a larger column 636, or larger reel, now covers the positions previously held by columns 622 and 624, and reels five and six. This shows the association between the shadow matrix 660 of FIG. 6D, which is used to process a game result, and the visible matrix shown in the display 600 of FIG. 6E, which is displayed to the user.

If an additional spin is not automatically initiated, the user may be shown the newly configured display as per FIG. 6E. If another spin is automatically initiated, typically at no additional cost to a user as it is in the present embodiment, the user's first view of the larger columns may be when the reels of the reconfigured visible matrix are spinning. Such a view is shown in FIG. 6F. As the present embodiment includes automatically spinning the reels again after a trigger event, FIG. 6F illustrates what may be a user's first view of the larger column 636, with the spinning of the reels simulated. It should be noted that a transition from smaller to larger columns and symbols may include appropriate animations.

The enlarged symbols, which form an enlarged reel or column on the display, indicates to the user the importance and value of symbols thereon. The large symbol extends across more than one of the original positions and will, therefore, be considered to cover these positions when a game result is determined. As a result, landing one enlarged symbol that matches four symbols to its left (i.e., the four symbols before it on the same pay line, in the present embodiment), will result in a pay-out as if six symbols have landed on the same pay line. Accordingly, the larger symbol carries more value to a user, and its size emphasizes this in a manner that is simple for a user to recognize. By keeping the shadow matrix in a standard format used to process a game result, but with the modifications as described above, modifications to the paytable may be avoided. As noted above, maintaining the matrix in a standard form obviates the need for providing additional code and pay table entries associated with the reconfigured GUI matrix, thus obviating the need for additional memory to store additional pay table entries.

Moving then to FIG. 6G, the spinning reels from FIG. 6F are brought to a halt in new, randomly determined positions. The display 600 in FIG. 6G is shown to the user. The symbol positions of FIG. 6G lead to another win for the user, with Queen symbols filling the entire second pay line 604. In line with the description above, in the shadow matrix 660 used to determine the game result, there will be six Queen symbols on the second pay line 604.

As a result of this new win with all Queen symbols on the second pay line 604, another trigger event is detected, and the method may proceed accordingly. This is then a second consecutive trigger event and a second consecutive win. The shadow matrix 660 used to process a game result, and the visible matrix shown to the user on the display 600, may again be reconfigured. This is, again, done by first increasing the stacking on the primary reel strip of the primary reel, still, the rightmost reel, or the sixth reel, associated with column 624 of the shadow matrix. After the stacking described with reference to FIG. 6D, the stacking provided groups of two symbols. It now increases to groups of three symbols, so that the same symbol is provided in three consecutive positions on the primary reel strip associated with the primary reel.

FIG. 6H shows the shadow matrix 660 after another round of stacking, coupling, and applying, for illustrative purposes. In the shadow matrix associated with the display 600 of FIG. 6G, a queen symbol would have been located in the first row 602, and fifth column 620 and sixth column 624, and second row 604, fifth column 620, and sixth column 624. Increasing the stacking has the result that there are now three stacked Queen symbols in the sixth column 624, as shown in FIG. 6H. All symbols on the sixth reel will now be in stacks of three. It should be noted that the fifth column 622 and sixth column 624 are still coupled.

Further, the primary reel (associated with column 624) is coupled to an uncoupled, adjacent, secondary reel. The uncoupled reel that is adjacent to the primary reel is now the fourth reel, being associated with column 620, as the fifth reel is not uncoupled. The fourth reel is now the secondary reel and will then also turn with and land with the sixth reel. The primary reel strip, being the reel associated with the primary reel on column 624, is applied to all coupled reels, i.e., the fourth reel and the fifth reel. Accordingly, the fourth, fifth, and sixth reels are now identical and will turn and land together. A symbol that lands on the fourth reel in column 620 will, therefore, also land next to it on the fifth reel in column 622 and the sixth reel in column 624. A Queen symbol is shown on the first row 602, columns 620, 622 and 624, second row 604, columns 620, 622 and 624, and third row 606, columns 620, 622, and 624. This forms a group of nine Queen symbols.

It should be noted that this description of stacking symbols, coupling reels, and applying reels with reference to FIG. 6H need not happen as shown, wherein the symbols that landed in a previous spin are stacked, coupled, and copied from their previous positions. Typically, the new configuration will only be used during the next spin of the reels. It should be noted that, in fact, a new virtual reel strip may be used for at least the primary reel after re-configuration of the matrix, with the new virtual reel strip then also applied to the fourth reel and fifth reel, with the fourth, fifth and sixth reels then being coupled during a future spin.

The first new view that the user sees may be similar to the display 600 shown in FIG. 6I, with the reels spinning. A still larger column 638 now extends across the previously visible columns 620 and 636. This even larger column 638, and symbols in the column, emphasizes the additional value of to these symbols. Now, landing one symbol will be as if three adjacent symbols have landed. Only four adjacent symbols on a pay line, in columns 614, 616, 618, and 638, will lead to a win as if six adjacent symbols landed on the pay line. In the background, however, the shadow matrix has its standard layout, and a game result may be processed in a normal manner.

Moving then to FIG. 6J, the spinning reels from FIG. 6I are brought to a halt in new, randomly determined positions. The display 600 in FIG. 6J is shown to the user. The symbol positions of FIG. 6J leads to another win for the user, with three King symbols appearing on the third pay line 612 on row 606 in columns 614, 616, and 618. An Ace symbol is shown to have landed in the large column 638 but does not form part of the winning combination of King symbols.

It should be noted that an activation symbol 640 has landed in row 604, column 616. This is recognized as an activation event, which leads to additional rows being activated in the shadow matrix and shown to the user on the display 600. The shadow matrix 660 now includes a fourth row 642 and a fifth row 644, which respectively have a fourth pay line 646 and a fifth pay line 648 associated therewith. This is shown in FIG. 6K. The shadow matrix is now a five by six matrix, with additional wins possible on the new fourth pay line 646 and fifth pay line 648.

As a result of the new win with three King symbols on the third pay line 606, as shown in FIG. 6J, another trigger event is detected, and the method may proceed accordingly. This is the third consecutive win and trigger event. The shadow matrix used to process a game result, and the visible matrix shown to the user on the display 600, may be further reconfigured (in addition to the added rows). This is, again, done by first increasing the stacking on the primary reel strip of the primary reel, still, the rightmost reel, or the sixth reel, associated with column 624 of the shadow matrix. The stacking of symbols now increases to provide groups of to four symbols. The same symbol is provided in four consecutive positions on a reel strip associated with the specific column.

FIG. 6K further shows the shadow matrix 660 after another round of stacking, coupling, and applying, for illustrative purposes. In the shadow matrix associated with the display 600 of FIG. 6J, an Ace symbol would have been located in the first row 602, fourth column 620, fifth column 622 and sixth column 624, second row 604 and fourth column 620, fifth column 622 and sixth column 624, and third row 606 and fourth column 620, fifth column 622 and sixth column 624. Increasing the stacking has the result that there are now four stacked Ace symbols in the sixth column 624, as shown in FIG. 6K. All symbols on the sixth reel will now be in groups of four. It should be noted that the fourth column 620, fifth column 622, and sixth column 624, are still coupled.

Further, the primary reel (associated with column 624) is coupled to an uncoupled, adjacent, secondary reel. The uncoupled reel that is adjacent to the primary reel is now the third reel, being associated with column 618, as the fifth reel and fourth reel are not uncoupled. The third reel is, therefore, the secondary reel. Now, the third reel will also turn with and land with the sixth reel. The coupled third reel, fourth reel, fifth reel, and sixth reel will all turn and land together. The primary reel strip, associated with the primary reel, is then applied to all the coupled reels, i.e., the third reel, fourth reel, and the fifth reel. Accordingly, the third, fourth, fifth, and sixth reels in the shadow matrix 660 are now identical and will turn and land together. Any symbol that lands on the third reel in column 618 will also land next to it on the fourth reel in column 620, the fifth reel in column 622, and the sixth reel in column 624. An Ace symbol is shown on the first row 602, second row 604, third row 624, and fourth row 642, in their columns 618, 620, 622, and 624. This forms a group of sixteen Ace symbols.

Again, it should be noted that this description of stacking symbols, coupling reels, and applying reels with reference to FIG. 6K need not happen as shown, wherein the symbols that landed in a previous spin are stacked, coupled, and copied from their previous positions. In some embodiments, the new configuration will only be used during the next spin of the reels. It should be noted that a new virtual reel strip may be used for at least the primary reel after re-configuration of the matrix, with the new virtual reel strip then also applied to the other coupled and reels.

The first new view that the user sees may be similar to the display 600 shown in FIG. 6L, with the reels spinning. A still larger column 650 now extends across the previously visible columns 618 and 638. This even larger column, and symbols in the column, again emphasizes the additional value of these symbols. Now, landing one such large symbol will be as if four adjacent symbols have landed. Only three adjacent symbols on a pay line, in columns 614, 616, and 650, will lead to a win as if six adjacent symbols landed on the pay line. In the background, however, the shadow matrix has the normal layout, and a game result may be processed as normal.

Moving then to FIG. 6M, the spinning reels from FIG. 6L are brought to a halt in new, randomly determined positions. The display 600 in FIG. 6M is shown to the user. The symbol positions of FIG. 6M leads to another win for the user, with three King symbols appearing on the second pay line 610 on row 604 in columns 614, 616, and 650. As the large King symbol in column 650 forms part of the winning combination of King symbols, the win will be processed by relying on the shadow matrix, and it will be as if six adjacent King symbols landed on the second pay line 610.

As a result of the new win, another trigger event is detected, and the method may proceed accordingly. This is the fourth consecutive win, and the fourth consecutive trigger event. This is also the maximum number of consecutive trigger events, as detailed further below. The shadow matrix used to process a game result, and the visible matrix shown to the user on the display 600, may be further reconfigured. This is, again, done by first increasing the stacking on the primary reel strip of the primary reel, still, the rightmost reel, or the sixth reel, associated with column 624 of the shadow matrix. The stacking of symbols now increases to five symbols high. The same symbol is provided in five adjacent positions on the primary reel strip.

FIG. 6N shows the shadow matrix 660 after another round of stacking, coupling, and applying, for illustrative purposes. The additional activated rows remain active. In the shadow matrix associated with the display 600 of FIG. 6M, a King symbol would have been located in the third column 618, fourth column 620, fifth column 622, and sixth column 624 of the first row 602, second row 604, third row 606, and fourth row 642. Increasing the stacking has the result that there are now five stacked King symbols in the sixth column 624, as shown in FIG. 6N. All symbols on the sixth reel will now be in stacks of five. It should be noted that the third column 618, fourth column 620, fifth column 622, and sixth column 624 are still coupled.

Further, the primary reel (associated with column 624) is coupled to an uncoupled, adjacent, secondary reel. The uncoupled reel that is adjacent to the primary reel is now the second reel, being associated with column 616, as the third reel, fourth reel, and fifth reel are not uncoupled. The second reel is, therefore, now the secondary reel. Now, the second reel will also turn with and land with the sixth reel. The coupled second reel, third reel, fourth reel, fifth reel, and sixth reel will all turn and land together. The primary reel strip, being associated with column 624, is then applied to all the coupled reels, i.e., the second reel, third reel, fourth reel, and the fifth reel. Accordingly, the second, third, fourth, fifth, and sixth reels in the shadow matrix 660 are now identical and will turn and land together. Any symbol that lands on the second reel in column 616 will also land next to it on the third reel in column 618, the fourth reel in column 620, the fifth reel in column 622, and the sixth reel in column 624. A King symbol is shown on the first row 602, second row 604, third row 606, fourth row 642, and fifth row 644, and in their columns 616, 618, 620, 622, and 624. This forms a group of twenty-five King symbols.

Again, it should be noted that this description of stacking symbols, coupling reels, and applying reel strips with reference to FIG. 6K need not happen as shown, wherein the symbols that landed in a previous spin are stacked, coupled and copied from their previous positions. Typically, the new configuration will only be used during the next spin of the reels. It should be noted that a new virtual reel strip may again be used for at least the primary reel after re-configuration of the matrix, with the new virtual reel then also applied to the other coupled and copied reels.

The first new view that the user sees may be similar to the display 600 shown in FIG. 6O, with the reels spinning. A still larger column 652 now extends across the previously visible columns 616 and 650. This even larger column, and symbols in the column, again emphasizes the additional value of these symbols. Now, landing one such large symbol will be as if five adjacent symbols have landed. Only two adjacent symbols on a pay line, in columns 614 and 652, will lead to a win as if six adjacent symbols landed on the pay line. In the background, however, the shadow matrix has the normal layout, and a game result may be processed as normal.

Moving then to FIG. 6P, the spinning reels from FIG. 6O are brought to a halt in new, randomly determined positions. The display 600 in FIG. 6P is shown to the user. The symbol positions of FIG. 6P leads to another win for the user, with two Ace symbols appearing on the second pay line 610 on the second row 604 in columns 614 and 652, and the fifth pay line 648 on the fifth row 644 in columns 614 and 652. As the large Ace symbol in column 652 forms part of two winning combinations of Ace symbols, the win will be processed by relying on the shadow matrix, and it will be as if six adjacent Ace symbols landed on both the second pay line 610 and the fifth pay line 648.

Even though there was another win in FIG. 6P, another trigger event is not detected. The symbols in the display cannot be enlarged any more than their current size, as this will lead to indefinite wins as a single symbol covering all of the original six columns will require the shadow matrix to have the same symbol on all pay lines. As a result, the maximum number of consecutive trigger events is four. Even if a fifth consecutive win is obtained, the column cannot grow anymore, and a termination event will be detected after the fifth win. For any win before five consecutive wins, a trigger event will be recognized and the user will be presented with a growing column and symbols on the column, with the shadow matrix being configured as appropriate and as described above. However, any loss, and also a fifth consecutive win (which will occur after four consecutive trigger events), will be considered a termination event. Any termination event will lead to all coupled reels being uncoupled, all individual virtual reel strips being reset to their original configurations, and any stacking on the primary reel strip being reset. If different virtual reel strips were used during the modifications made to the shadow matrix, the original virtual reel strips may be restored. In addition, if any additional rows were activated during any sequence of wins, such rows will be de-activated after a termination event.

As a result, despite the fifth consecutive win of FIG. 6P, a termination event is recognized, and the display 600 of FIG. 6Q may be presented to the user. Now, the visible matrix shown to the user in the display 600 is again the same as the shadow matrix used to process a game result. The method may now restart, with a new wager required form the user to initiate a new play of the game.

It should be noted that the description above with reference to FIGS. 6A to 6Q shows the maximum number of consecutive trigger events. If at any stage, a win (trigger event) would not have been achieved, all coupled reels would be uncoupled, all individual reel strips reset to their original configuration, and all stacking on the primary reel strip would be reset. Any termination event during a sequence of consecutive events will result in the shadow matrix and the matrix in the display shown to the user return to the original condition, similar to that shown in FIG. 6Q.

If an activation event occurs, but no trigger event occurs, additional rows may or may not be activated. If they are activated, they may only be deactivated when a termination event occurs, which may be that the first spin with them being active does not lead to a win.

While only the sixth reel was used as a primary reel in the above description, any reel may be chosen as a primary reel. If the primary reel is the first reel, or leftmost reel, coupled reels may be limited to two, as three coupled reels that are the same on the first three reels may always lead to a win. However, this may be a game designer's intention, as the size of the guaranteed win may still be randomly determined. Then, the randomly determined fourth, fifth and/or sixth reels (as applicable) may determine the size of the guaranteed win. Similarly, a primary reel may be any middle reel, and coupling may be done to either or both sides. Then, "adjacent" uncoupled reels may be directional, i.e., the closest adjacent reel to the left, or the closest adjacent reel to the right, as chosen by a game designer.

The above embodiments only show six columns and three or five row matrixes; however, any possible matrix configuration may be provided. Any suitable configuration of pay lines may form part of the game, or it may even be a ways game in which symbols may land on any position in subsequent columns to constitute a win. Pay-outs may also be from right to left, and not only from left to right on a pay line. Similarly, an activation symbol may activate any number of additional rows and/or pay lines.

As mentioned above, the symbols used to describe aspects of the embodiments in FIGS. 6A to 6Q were chosen to simplify the explanation—any suitable number or types of symbols may be used by a game designer in the virtual reels.

As also mentioned, a specific virtual reel may be used for each number of coupled reels, as per game designer requirements.

A spin after any trigger event may be free, in which case it may function as a form of "free spins" feature, wherein the number of free spins is dependent on the consecutive number of trigger events (up to the predetermined maximum number of trigger events) that are obtained. In such embodiments, a pay-out for wins achieved during a sequence of consecutive wins may only be made after a termination event. In some embodiments, a user may be required to place a wager on a spin after a trigger event, which spin may need to be at the same wager than the spin that initiated the wager leading to the trigger event.

When the present systems and methods are incorporated into a wager-based system, a user that wishes to place a bet or wager on the outcome of a spin may need to establish a credit balance in an account that allows them to take part in the systems and methods. This may be, for example, the provision of a physical item that represents a monetary currency in a dedicated gaming machine, credit card details allowing an operator of the systems and methods to retrieve money for play of the game, an account associated with the operator or being accessible by the operator from which a credit value may be used, or the like. It is envisaged that, in the event of a user winning after a wager, payment of the user's winnings may be made into such an account or may be paid out in any other suitable format. Processing a result may include processing any winnings to the user's account.

Figure 7:
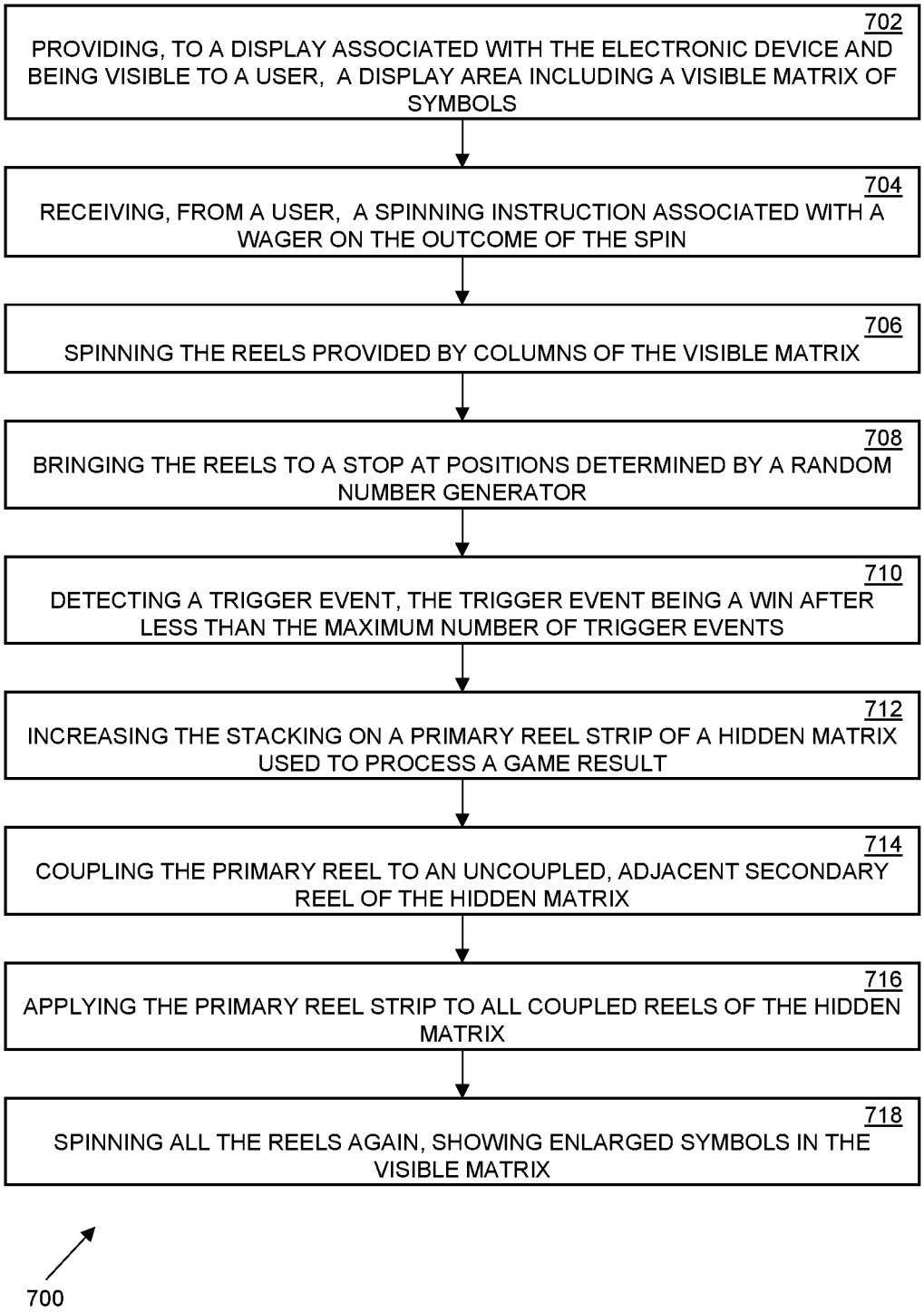
FIG. 7 is a flowchart of operations associated with example embodiments.

FIG. 7 depicts an example of a flowchart of operations that can be performed by the electronic device 302. It is noted that the functionality described in connection with the flowchart can be implemented via specialized and/or configured general-purpose hardware modules, a computer program or portions of program code executed by a processor for achieving specific logical functions, determinations, and/or steps described in connection with the flowchart shown in FIG. 7. Where used, program code can be stored on any type of computer-readable medium, for example, such as a storage device including a disk or hard drive.

In addition, each block of the flowchart shown in FIG. 7 may represent circuitry that is wired to perform the specific logical functions in the process. Unless specifically indicated, operations in the flowchart shown in FIG. 7 may be executed out of order from that shown or discussed, including substantially concurrent execution of separately described functions, or even in reverse order in some examples, depending on the functionality involved, so long as the overall functionality of the described method is maintained.

Block 702 includes providing, to a display associated with the electronic device and being visible to the user, a display area including a visible matrix of symbols.

Block 704 includes receiving, from the user, a spinning instruction associated with a wager on the outcome of the spin.

Block 706 includes spinning the reels provided by columns of the visible matrix.

Block 708 includes bringing the reels to a stop at positions determined by a random number generator.

Block 710 includes detecting a trigger event, the trigger event being win after less than a maximum number of consecutive trigger events.

Block 712 includes increasing the stacking on a primary reel strip of a shadow matrix used to process a game result.

Block 714 includes coupling the primary reel to an uncoupled, adjacent secondary reel of the shadow matrix.

Block 716 includes applying the primary reel strip to all coupled reels of the shadow matrix.

Block 718 includes spinning all the reels again while showing enlarged symbols in the visible matrix.

iv. Additional Example Embodiments

The techniques disclosed in the examples described above can be applied to solve other problems. For example, in the fast-food industry, kiosks are being used to lower costs. The kiosk can display a GUI that facilitates ordering one or more meals. However, a typical kiosk can present too much information, making it difficult for customers to place orders. The symbol grouping techniques described above can help reduce clutter presented in the GUI to provide the customer with a more pleasing ordering experience.

Figure 8A:
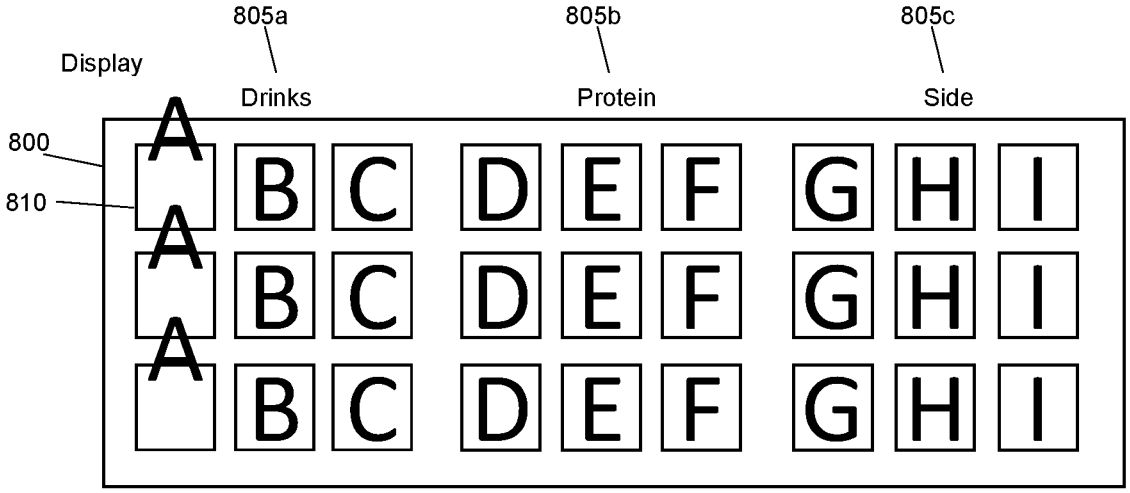
FIG. 8A illustrates a GUI that can be depicted on a kiosk, in accordance with an example embodiment.

For example, referring to FIG. 8A, the kiosk can display a GUI matrix 800, where each row 810 corresponds to a different order combination. Columns can be group based on the types of food items. For example, a first group of columns 805*a* can indicate various drink options. A second group of columns 805*b* can indicate various protein options. A third group of columns 805*c* can indicate various side options. The kiosk can be configured so that only one item within each column group can be selected.

Figure 8B:
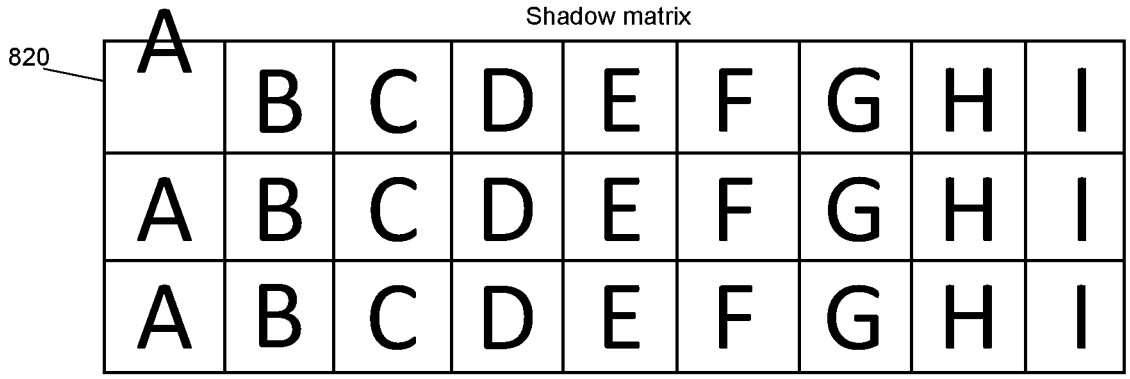
FIG. 8B illustrates a shadow matrix associated with the GUI of FIG. 8A, in accordance with an example embodiment.

As shown in FIG. 8B, a shadow matrix 820 can be initially configured so that the values of the cells of the shadow matrix 820 are associated with the symbols depicted in the GUI matrix 800.

Figure 8C:
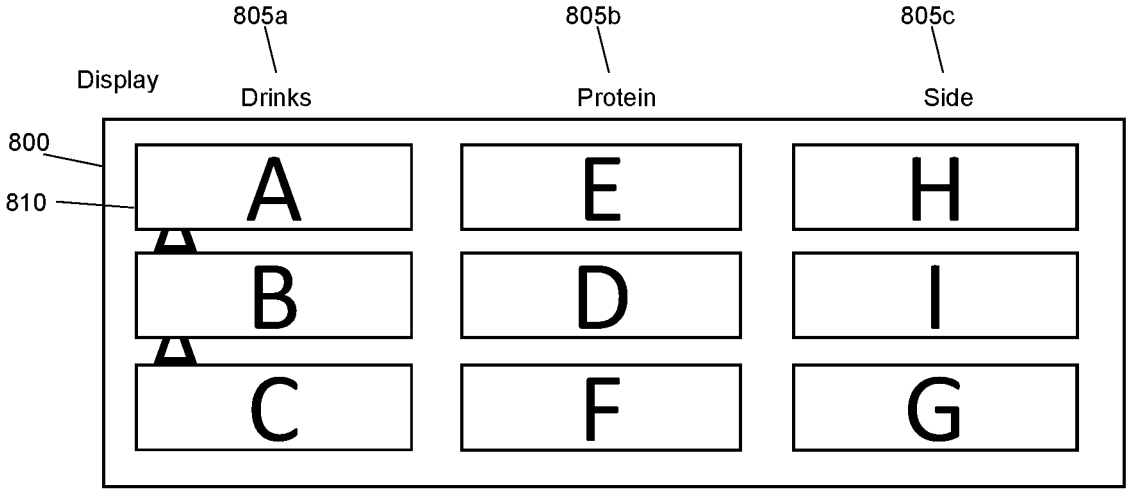
FIG. 8C illustrates emphasizing symbols of the GUI of FIG. 8A, in accordance with an example embodiment.

As shown in FIG. 8C, a user can select one item from each column group for three separate orders. After the selection of each item, the selected symbol can be enlarged to emphasize the selection made by the user.

Figure 8D:
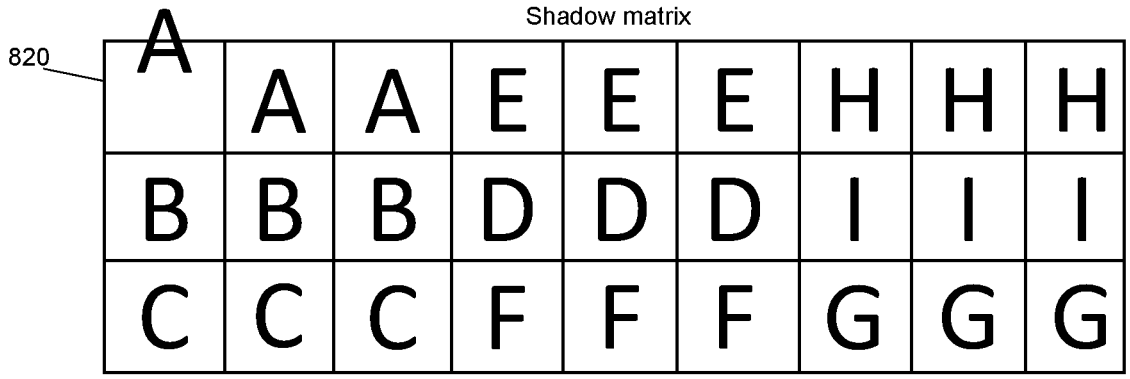
FIG. 8D illustrates a shadow matrix associated with the GUI of FIG. 8C, in accordance with an example embodiment.

As shown in FIG. 8D, the cells of the shadow matrix 820 can be updated, so the values associated with the selected/emphasized symbols are copied to adjacent cells of the shadow matrix. As noted in the earlier examples, organizing the shadow matrix 820 in this way can obviate the need for providing additional code and pay table entries associated with the reconfigured GUI matrix. This, in turn, can lower the memory requirements associated with the kiosk.

Figure 9:
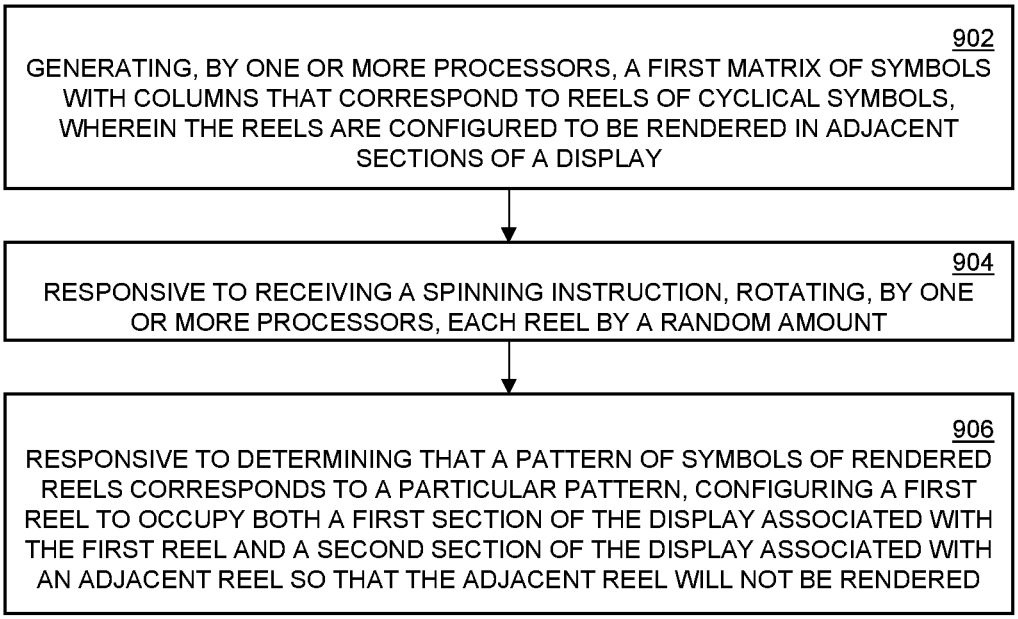
FIG. 9 is a flowchart that illustrates a variation of the operations associated with the example embodiments.

FIG. 9 illustrates a computer-implemented method 900. Block 902 can involve generating, by one or more processors, a first matrix of symbols with columns that correspond to reels of cyclical symbols, wherein the reels are configured to be rendered in adjacent sections of a display.

Block 904 can involve responsive to receiving a spinning instruction, rotating, by one or more processors, each reel by a random amount.

Block 906 can involve responsive to determining that a pattern of symbols of the rendered reels corresponds to a particular pattern, configuring a first reel to occupy both a first section of the display associated with the first reel and a second section of the display associated with an adjacent reel so that the adjacent reel will not be rendered In some examples, configuring the first reel to occupy both the first section of the display and the second section of the display can involve stacking the symbols of the first reel so that every two consecutive symbols of the first reel match.

Some examples can involve responsive to receiving a second spinning instruction, rotating, by one or more processors, each rendered reel by a random amount; and responsive to determining a pattern of symbols of the rendered reels corresponds to a particular pattern, configuring the first reel to occupy a third section of the display associated with a further adjacent rendered reel so that the adjacent reel is no longer visible.

Some examples can involve storing, by the one or more processors, information that defines a second matrix of symbols. The initial configuration of symbols of the first matrix matches an initial configuration of symbols of the second matrix. In these examples, determining that a pattern of symbols of the rendered reels corresponds to a particular pattern can involve determining that a pattern of symbols of the second matrix corresponds to a particular pattern.

Some examples can involve determining that a pattern of symbols of the second matrix corresponds to a particular pattern when all the symbols in a particular row of the second matrix match.

In some examples, responsive to determining that a pattern of symbols of the second matrix corresponds to a particular pattern can involve for each row of the second matrix, copying, by the one or more processors, a symbol in a first column of the second matrix that is associated with the first reel to a second column of the second matrix that is associated with the adjacent reel to thereby couple the first column to the second column.

Some examples can involve stacking the symbols of the first column of the second matrix so that every two consecutive symbols of the first column match.

Some examples can involve responsive to determining that a particular symbol exists in a row of the second matrix and adding a further row of symbols to the first matrix and the second matrix for rendering on the display.

In some examples, rotating, by one or more processors, each reel by a random amount can involve animating the reel to simulate spinning of the reel.

Figure 10:
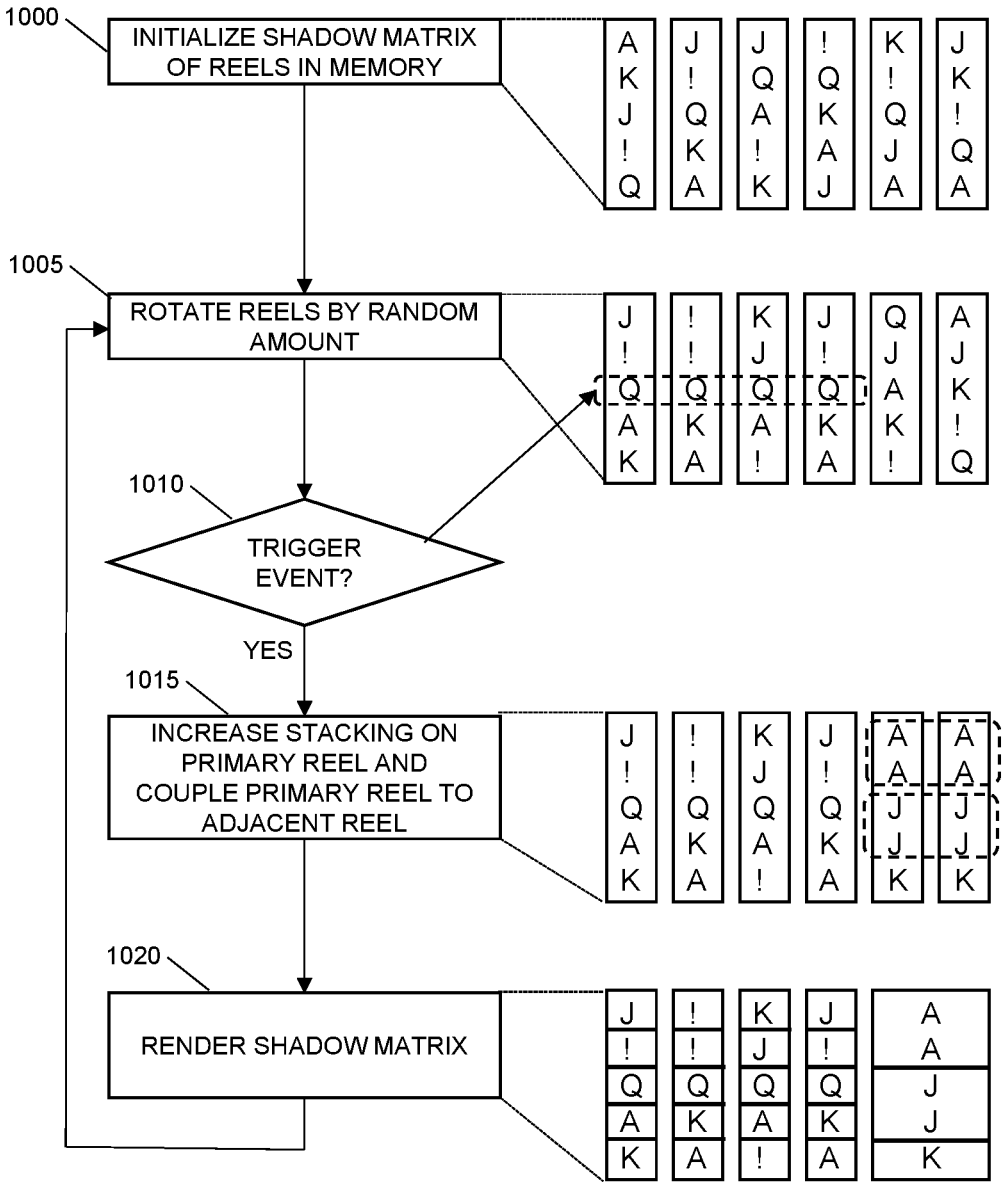
FIG. 10 is a flow diagram, in accordance with example embodiments.

FIG. 10 is a flow diagram, in accordance with example embodiments. Referring to FIG. 10, Block 1000 can involve initializing a shadow matrix of reels in memory of a computer system.

Block 1005 can involve rotating the reels in the memory by a random amount.

Block 1010 can involve determining whether a trigger event associated with the rotated reels has occurred. For example, a trigger event can occur when the symbols in the rotated reels match a particular pattern specified in a pay table.

Block 1015 can involve increasing the stacking of the primary reel and coupling the primary reel to an adjacent reel.

Block 1020 can involve rendering the shadow matrix to, for example, a display.

In the operations, data that represents the symbols of the reels is maintained in a shadow matrix stored in memory. A processor can determine the existence of particular patterns from the shadow matrix and search a table in memory for scores associated with the patterns. Data in the shadow matrix is copied between cells of the shadow matrix to correspond to the rendered reels in such a way as to obviate increasing the size of the table. This, in turn, reduces memory requirements associated with the rendering of the reels.

v. Conclusion

This detailed description describes various features and functions of the disclosed systems, devices, and methods with reference to the accompanying figures. In the figures, similar symbols typically identify similar components, unless context dictates otherwise. The illustrative embodiments described in the detailed description, figures, and claims are not meant to be limiting. Other embodiments can be used, and other changes can be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

With respect to any or all of the message flow diagrams, scenarios, and flow charts in the figures and as discussed herein, each step, block and/or communication can represent a processing of information and/or a transmission of information in accordance with example embodiments. Alternative embodiments are included within the scope of these example embodiments. In these alternative embodiments, for example, functions described as steps, blocks, transmissions, communications, requests, responses, and/or messages can be executed out of order from that shown or discussed, including in substantially concurrent or in reverse order, depending on the functionality involved. Further, more or fewer steps, blocks and/or functions can be used with any of the message flow diagrams, scenarios, and flow charts discussed herein, and these message flow diagrams, scenarios, and flow charts can be combined with one another, in part or in whole.

A step or block that represents a processing of information can correspond to circuitry that can be configured to perform the specific logical functions of a herein-described method or technique. Alternatively or additionally, a step or block that represents a processing of information can correspond to a module, a segment, or a portion of program code (including related data). The program code can include one or more instructions executable by a processor for implementing specific logical functions or actions in the method or technique. The program code and/or related data can be stored on any type of computer-readable medium such as a storage device including a disk or hard drive or other storage media.

The computer-readable medium can include non-transitory computer-readable media such as computer-readable media that stores data for short periods of time like register memory, processor cache, and/or random-access memory (RAM). The computer-readable media can include non-transitory computer-readable media that stores program code and/or data for longer periods of time, such as secondary or persistent long term storage, like read-only memory (ROM), optical or magnetic disks, and/or compact-disc read-only memory (CD-ROM), for example. The computer-readable media can be any other volatile or non-volatile storage systems. A computer-readable medium can be considered a computer-readable storage medium, for example, or a tangible storage device.

Software for use in carrying out the disclosed embodiments can also be in transitory form, for example in the form of signals transmitted over a network such as the Internet. Moreover, a step or block that represents one or more information transmissions can correspond to information transmissions between software and/or hardware modules in the same physical device. However, other information transmissions can be between software modules and/or hardware modules in different physical devices.

Further, the described operations throughout this application need not be performed in the disclosed order. Also, not all operations need to be performed to achieve the desired advantages of disclosed machines and methods, and therefore not all operations are required.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

While examples have been described in terms of select embodiments, alterations and permutations of these embodiments will be apparent to those of ordinary skill in the art. Other changes, substitutions, and alterations are also possible without departing from the disclosed machines and methods in their broader aspects as set forth in the following claims.

What is claimed is:

1. A computer-implemented method for a purpose-built gaming machine with reduced memory requirements for a user interface, the method comprising:

generating, by one or more processors, a first matrix of symbols with columns that correspond to reels of cyclical symbols, wherein the reels are configured to be rendered in adjacent sections of a display;

responsive to receiving a spinning instruction, rotating, by one or more processors, each reel by a random amount; and responsive to determining that a pattern of symbols of rendered reels corresponds to a particular pattern, configuring a first reel to occupy both a first section of the display associated with the first reel and a second section of the display associated with an adjacent reel so that the adjacent reel will not be rendered;

storing, by the one or more processors, information that defines a second matrix of symbols, wherein an initial configuration of symbols of the first matrix matches an initial configuration of symbols of the second matrix, wherein determining that a pattern of symbols of the rendered reels corresponds to a particular pattern comprises determining that a pattern of symbols of the second matrix correspond to a particular pattern; and determining that a pattern of symbols of the second matrix corresponds to a particular pattern when all the symbols in a particular row of the second matrix match, wherein responsive to determining that a pattern of symbols of the second matrix corresponds to a particular pattern further comprises:

for each row of the second matrix, copying, by the one or more processors, a symbol in a first column of the second matrix that is associated with the first reel to a second column of the second matrix that is associated with the adjacent reel to thereby couple the first column to the second column;

stacking the symbols of the first column of the second matrix so that every two consecutive symbols of the first column match; and responsive to determining that a particular symbol exists in a row of the second matrix, adding a further row of symbols to the first matrix and the second matrix for rendering on the display.

2. The computer-implemented method according to claim 1, wherein configuring the first reel to occupy both the first section of the display and the second section of the display further comprises:

stacking the symbols of the first reel so that every two consecutive symbols of the first reel match.

3. The computer-implemented method according to claim 2, further comprising;

responsive to receiving a second spinning instruction, rotating, by one or more processors, each rendered reel by a random amount; and responsive to determining a pattern of symbols of the rendered reels corresponds to a particular pattern, configuring the first reel to occupy a third section of the display associated with a further adjacent rendered reel so that the adjacent reel is no longer visible.

4. The computer-implemented method of claim 1, wherein rotating, by one or more processors, each reel by a random amount further comprises animating the reel to simulate spinning of the reel.

5. An article of manufacture including a non-transitory computer-readable medium, having stored thereon program instructions for a purpose-built gaming machine with reduced memory requirements for a user interface that, wherein upon execution by a processor, causes the processor to perform operations comprising:

generating a first matrix of symbols with columns that correspond to reels of cyclical symbols, wherein the reels are configured to be rendered in adjacent sections of a display;

responsive to receiving a spinning instruction, rotating each reel by a random amount;

responsive to determining that a pattern of symbols of rendered reels corresponds to a particular pattern, configuring a first reel to occupy both a first section of the display associated with the first reel and a second section of the display associated with an adjacent reel so that the adjacent reel will not be rendered;

storing information that defines a second matrix of symbols, wherein an initial configuration of symbols of the first matrix matches an initial configuration of symbols of the second matrix, wherein determining that a pattern of symbols of the rendered reels corresponds to a particular pattern comprises determining that a pattern of symbols of the second matrix correspond to a particular pattern;

determining that a pattern of symbols of the second matrix corresponds to a particular pattern when all the symbols in a particular row of the second matrix match, wherein responsive to determining that a pattern of symbols of the second matrix corresponds to a particular pattern further comprises:

for each row of the second matrix, copying, by the one or more processors, a symbol in a first column of the second matrix that is associated with the first reel to a second column of the second matrix that is associated with the adjacent reel to thereby couple the first column to the second column;

stacking the symbols of the first column of the second matrix so that every two consecutive symbols of the first column match; and responsive to determining that a particular symbol exists in a row of the second matrix, adding a further row of symbols to the first matrix and the second matrix for rendering on the display.

6. The article of manufacture of claim 5, wherein configuring the first reel to occupy both the first section of the display and the second section of the display further comprises:

stacking the symbols of the first reel so that every two consecutive symbols of the first reel match.

7. The article of manufacture of claim 6, wherein execution of the program instructions causes the processor to perform operations comprising:

responsive to receiving a second spinning instruction, rotating by a random amount; and responsive to determining a pattern of symbols of the rendered reels corresponds to a particular pattern, configuring the first reel to occupy a third section of the display associated with a further adjacent rendered reel so that the adjacent reel is no longer visible.

8. The article of manufacture of claim 5, wherein rotating each reel by a random amount further comprises:

animating the reel to simulate spinning of the reel.

9. A computer system for a purpose-built gaming machine with reduced memory requirements for a user interface comprising:

a display device;

a plurality of input devices including (i) an acceptor device configured to receive and validate a physical item associated with a monetary value, and (ii) a cash-out button actuatable to cause an initiation of a payout associated with a credit account;

at least one processor; and at least one memory device that stores instructions executable by the processor to cause the processor to perform operations comprising:

generating a first matrix of symbols with columns that correspond to reels of cyclical symbols, wherein the reels are configured to be rendered in adjacent sections of the display device;

responsive to receiving a spinning instruction via one of the plurality of input devices, rotating each reel by a random amount; and responsive to determining that a pattern of symbols of rendered reels corresponds to a particular pattern, configuring a first reel to occupy both a first section of the display device associated with the first reel and a second section of the display device associated with an adjacent reel so that the adjacent reel will not be rendered;

storing information that defines a second matrix of symbols, wherein an initial configuration of symbols of the first matrix matches an initial configuration of symbols of the second matrix, wherein determining that a pattern of symbols of the rendered reels corresponds to a particular pattern comprises determining that a pattern of symbols of the second matrix correspond to a particular pattern;

determining that a pattern of symbols of the second matrix corresponds to a particular pattern when all the symbols in a particular row of the second matrix match, wherein responsive to determining that a pattern of symbols of the second matrix corresponds to a particular pattern further comprises:

for each row of the second matrix, copying, by the one or more processors, a symbol in a first column of the second matrix that is associated with the first reel to a second column of the second matrix that is associated with the adjacent reel to thereby couple the first column to the second column;

stacking the symbols of the first column of the second matrix so that every two consecutive symbols of the first column match; and responsive to determining that a particular symbol exists in a row of the second matrix, adding a further row of symbols to the first matrix and the second matrix for rendering on the display.

10. The computer system of claim 9, wherein configuring the first reel to occupy both the first section of the display and the second section of the display further comprises:

stacking the symbols of the first reel so that every two consecutive symbols of the first reel match.

* * * * *